US006405718B1

(12) United States Patent
Yoshioka et al.

(10) Patent No.: US 6,405,718 B1
(45) Date of Patent: Jun. 18, 2002

(54) MALFUNCTION TEST APPARATUS FOR FUEL VAPOR PURGE SYSTEM

(75) Inventors: Mamoru Yoshioka, Anjyo; Yoshihiko Hyodo, Gotenba; Naoya Takagi, Susono, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 51 days.

(21) Appl. No.: 09/613,766

(22) Filed: Jul. 11, 2000

(30) Foreign Application Priority Data

Jul. 30, 1999 (JP) ..... 11-218012

(51) Int. Cl.[7] ..... F02M 37/04
(52) U.S. Cl. ..... 123/520; 123/198 D
(58) Field of Search ..... 123/198 D, 520, 123/519, 518, 516, 521

(56) References Cited

U.S. PATENT DOCUMENTS 5,191,870 A * 3/1993 Cook ..... 123/520
5,261,379 A * 11/1993 Lipinski et al. ..... 123/520
5,671,718 A * 9/1997 Curran et al. ..... 123/520
6,105,556 A 8/2000 Takaku et al.
6,148,803 A 11/2000 Majima et al.
6,283,098 B1 * 9/2001 Corkill

FOREIGN PATENT DOCUMENTS

JP A 6-74104 3/1994

* cited by examiner

*Primary Examiner*—Carl S. Miller
(74) *Attorney, Agent, or Firm*—Oliff & Berridge, PLC

(57) ABSTRACT

A fuel vapor purge system connects a fuel tank with a canister and collects fuel vapor generated in the fuel tank by the canister. The purge system purges the collected fuel vapor to an intake passage of an internal combustion engine through a purge passage. A change of pressure due to fuel vapor generation in the fuel tank is measured while the purge passage is sealed. The pressure in the purge passage is differentiated from the pressure outside the purge passage and the purge passage is sealed. In this state, a change of the pressure in the purge passage is measured. After measuring the amount of generated fuel vapor, a test for leakage in the purge passage is performed based on the change of pressure due to the fuel vapor generation when measuring changes of pressure in the purge passage during a predetermined period.

12 Claims, 18 Drawing Sheets

MALFUNCTION TEST APPARATUS FOR FUEL VAPOR PURGE SYSTEM

BACKGROUND OF THE INVENTION

The present invention relates to a malfunction test apparatus for a fuel vapor purge system used in an internal combustion engine of a vehicle such as an automobile.

Fuel vapor purge systems for sending fuel vapor in a fuel tank to an intake passage have been proposed. Specifically, a fuel vapor purge system collects fuel vapor in a fuel tank to a canister and purges the collected fuel vapor to the intake passage as necessary to prevent fuel vapor from being emitted to the atmosphere. Such a purge system includes a canister, a fuel vapor passage and a vapor line. The canister collects fuel vapor in the fuel tank. The fuel vapor passage connects the fuel tank with the canister. The purge line connects the canister with an intake passage. A purge control valve is located in the purge line to adjust the opening size of the purge line. The canister has an atmospheric control valve, through which the canister is selectively exposed to the atmosphere.

When there is a puncture in piping or when a pipe is dislocated, fuel vapor is emitted into the atmosphere from the canister and the fuel tank. Preferably, such leakage is automatically discovered.

Therefore, a leakage test system that differentiates the pressure in a purge system from the outside pressure of the exterior and monitors changes of the purge system pressure has been introduced. For example, the system exposes the interior of the purge system to the negative pressure in an intake system of an engine and closes inlet and outlet passages to seal the purge system. Then, the system monitors changes of the internal pressure of the purge system.

When testing the purge line, the pressure in the purge line is lowered to a negative pressure and changes in the pressure are monitored. To test the purge system, the amount of fuel vapor needs to be in a certain range. If the amount of fuel vapor is out of the range, it cannot be judged whether an increase in the pressure in the purge line is due to atmospheric pressure introduced through puncture or to an excessive amount of fuel vapor.

Japanese Unexamined Patent Publication No. 6-74104 discloses a purge system, n which a canister is constantly connected to the interior f a fuel tank. When diagnosing the system, inlets and out Lets must be closed by valves to seal the purge line to measure the amount of fuel vapor in the system. Thus, purging must be stopped when measuring the amount of fuel vapor, which decreases the amount of purged fuel vapor. The purged fuel vapor may therefore be insufficient.

SUMMARY OF THE INVENTION

Accordingly, it is an objective of the present invention to provide a malfunction test apparatus for fuel vapor purge systems that shortens time required for testing and improves the purging effectiveness.

To achieve the foregoing and other objectives and in accordance with the purpose of the present invention, a malfunction test apparatus for a fuel vapor purge system is provided. The apparatus includes a purge system and testing means. The purge system connects a fuel tank with a canister and collects fuel vapor generated in the fuel tank in the canister. The purge system purges the collected fuel vapor to an intake passage of an internal combustion engine through a purge passage. The purge passage includes the fuel tank.

The testing means seals the purge passage and measures a change of pressure due to fuel vapor generation in the fuel tank. The testing means measures a rate of change of the pressure in the purge passage after differentiating the pressure in the purge passage from the pressure outside the purge passage and after sealing the purge passage. The testing means determines whether there is a leak in the purge passage based on the change of pressure due to fuel vapor generation and on the measured rate of change of the pressure in the purge passage. After measuring the change of pressure due to fuel vapor generation, the testing means determines that there is a leak in the purge passage only if the change of pressure due to fuel vapor generation satisfies a predetermined condition.

The present invention may also be embodied in a method for determining whether a malfunction has occurred in a fuel vapor purge system. The purge system connects a fuel tank with a canister and collects fuel vapor generated in the fuel tank by the canister. The purge system purges the collected fuel vapor to an intake passage of an internal combustion engine through a purge passage. The purge passage includes the fuel tank. The method includes measuring a change of pressure due to fuel vapor generation in the fuel tank while sealing the purge passage, and determining whether there is a leak in the purge passage based on the change of pressure due to fuel vapor generation and based on the rate at which the pressure in the purge passage approaches atmospheric pressure when the purge passage is sealed.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A malfunction test apparatus for a fuel vapor purge system according to a first embodiment of the present invention will now be described with reference to FIGS. 1 to 7.

Figure 1:
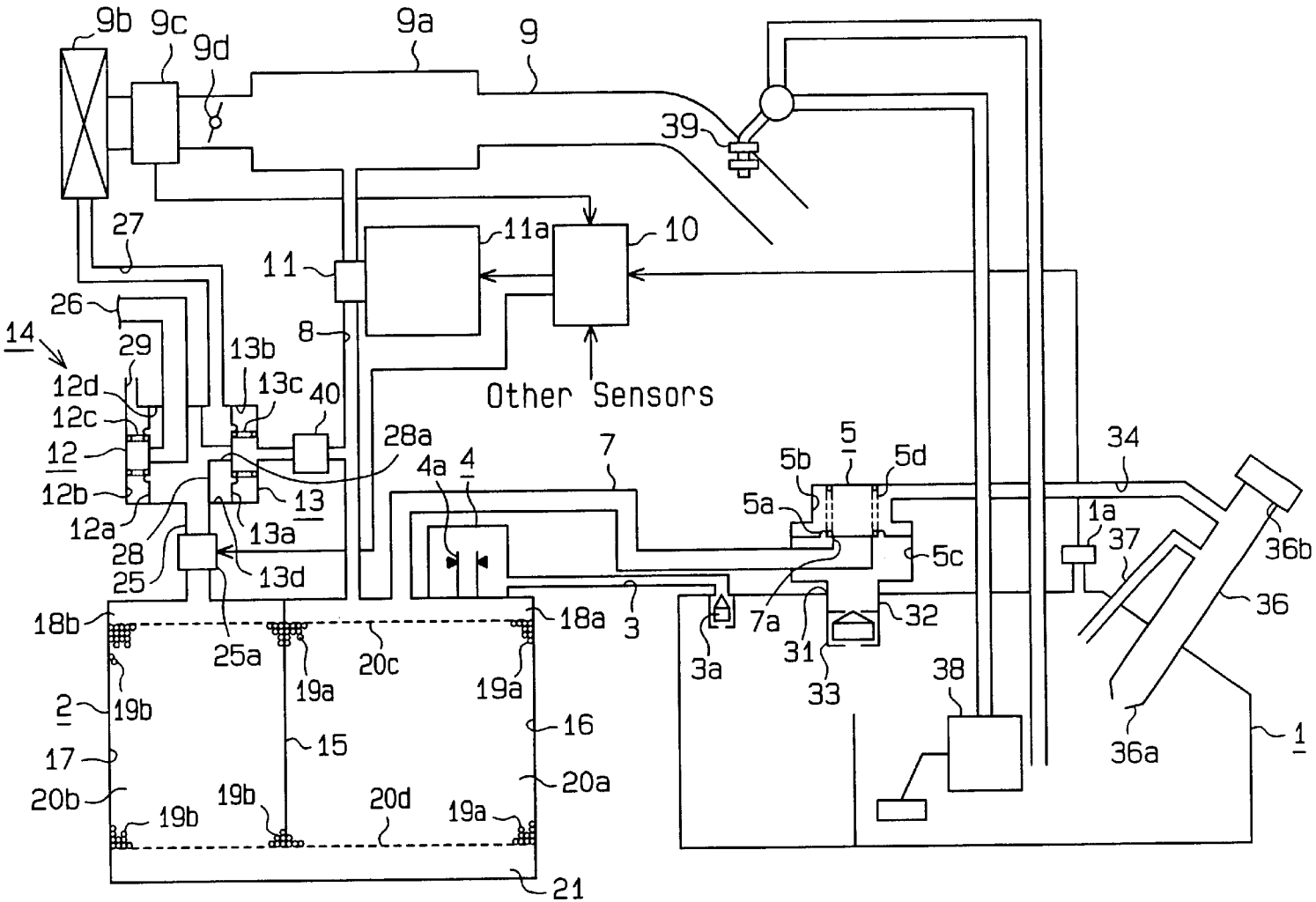
FIG. 1 is a diagrammatic view illustrating a fuel vapor purge system according to a first embodiment.

FIG. 1 is a diagrammatic view illustrating a fuel vapor purge system of the first embodiment. The purge system is used for a gasoline engine of a vehicle.

A fuel tank 1 of the gasoline engine is connected to a canister 2 by a fuel vapor passage 3. A float 3*a* is located in the vicinity of the port of the passage 3 in the fuel tank 1. Fuel vapor in the fuel tank 1 is drawn to the canister 2 by the fuel vapor passage 3. The passage 3 is connected to the canister 2 through a pressure buffer chamber 4 located on top of the canister 2. An orifice 4*a* in the chamber 4 constantly communicates the interior of the tank 1 with the interior of the canister 2 to equalize the pressure in the tank 1 with the pressure in the canister 2.

A differential valve 5 is located above the fuel tank 1. The differential valve 5 is connected to the canister 2 by a breather passage 7. When fuel is being supplied to the fuel tank 1, the differential valve 5 is opened. When the valve 5 is open, fuel vapor in the fuel tank 1 flows to the canister 2 through the breather passage 7.

The canister 2 is connected to a surge tank 9*a* by a purge line 8. The surge tank 9*a* forms part of an engine intake passage 9. A purge control valve 11 is located in the purge line 8. The purge control valve 11 is actuated by a drive circuit 11*a*. The drive circuit 11*a* is controlled by signals from an electronic control unit (ECU) 10, which is a microcomputer.

For example, the purge control valve 11 adjusts the amount of purged fuel from the canister 2 to the intake passage 9 during a purge control procedure. The purge control valve 11 seals and opens the purge line 8 during a malfunction test. The purge control valve 11 is, for example, a vacuum switching valve (VSV).

The interior of the canister 2 is divided into two chambers by a vertical partition wall 15. That is, the partition wall 15 defines a main chamber 16 and an auxiliary chamber 17. The main chamber 16 is located below the pressure buffer chamber 4 and the auxiliary chamber 17 is located below an atmospheric control valve 14. The volume of the auxiliary chamber 17 is less than that of the main chamber 16. Spaces 18*a*, 18*b* are formed in the chambers 16, 17, respectively. Adsorbent layers 20*a*, 20*b* are located below the spaces 18*a*, 18*b*, respectively. The adsorbent layers 20*a*, 20*b* include activated carbon adsorbent 19*a*, 19*b*, respectively.

A filter 20*c* is located on top of the adsorbent layers 20*a*, 20*b*. A filter 20*d* is located underneath the adsorbent layers 20*a*, 20*b*. The adsorbent 19*a*, 19*b* fill the space between the filters 20*c*, 20*d*. The space below the filter 20*d* is a diffusion chamber 21. The diffusion chamber 21 communicates the main chamber 16 with the auxiliary chamber 17.

One end of the breather passage 7 is connected to part of the upper surface of the canister 2 that corresponds to the main chamber 16. The purge line 8 is also connected to the main chamber 16 at a location near the breather passage 7 as shown in FIG. 1.

When the purge control valve 11 is open and the pressure in the canister 2 is negative, the surge tank 9*a* is connected to the fuel tank 1 through the interior of the purge line 8, the pressure buffer chamber 4 and the fuel vapor passage 3. Since the interior of the breather passage 7 is constantly connected to the main chamber 16, the breather passage 7 is connected to the purge line 8. These connected spaces function as a purge passage when the canister 2 has a negative pressure. The malfunction test apparatus monitors whether there is leakage from the purge passage.

A port 25 is located above the auxiliary chamber 17. The atmosphere control valve 14 is connected to the port 25. A block valve 25*a* is located in the port 25. The block valve 25*a* is normally maintained open. During a malfunction test, the ECU 10actuates the valve 25*a*. The valve 25*a* is, for example, a vacuum switch valve.

Figure 2A:
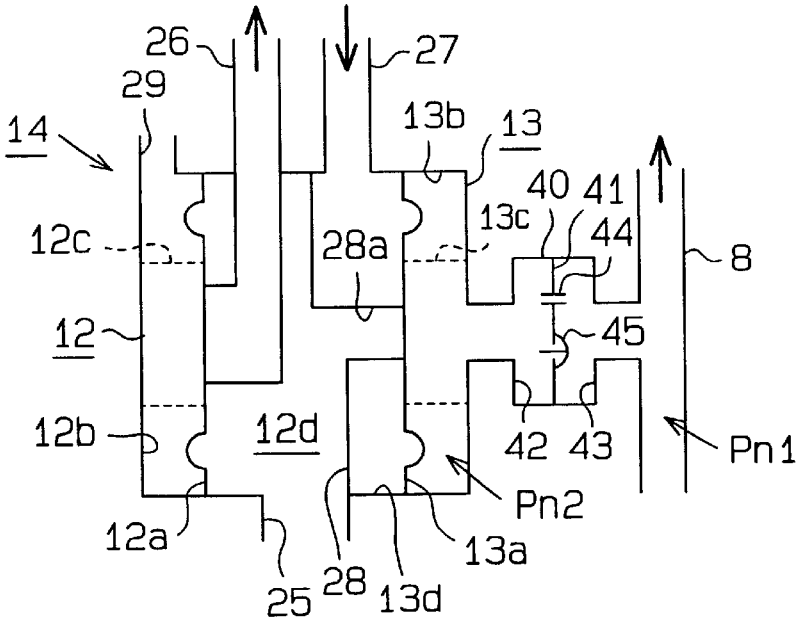
FIGS. 2(*a*) and 2(*b*) are diagrammatic views showing operation of the atmospheric control valve of the system shown in FIG. 1.
Figure 2B:
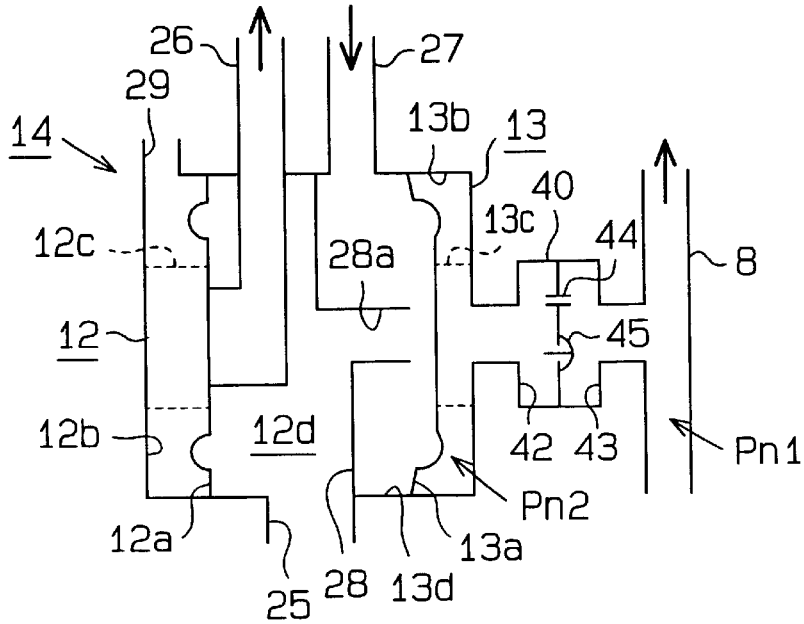

As shown in FIGS. 2(*a*), 2(*b*), the atmospheric control valve 14 includes a release control valve 12 and an atmosphere introduction control valve 13. The release control valve 12 has a diaphragm 12*a*, which defines an atmospheric chamber 12*b* to its left as viewed in the drawings. The introduction control valve introduction control valve 13 has a diaphragm 13*a*, which defines a negative pressure chamber 13*b* to its right as viewed in the drawings. The space between the diaphragms 12*a*, 13*a* is divided into two chambers by a partition wall 28. One of the chambers is a positive pressure chamber 12*d* of the release control valve 12. The other chamber is an atmospheric pressure chamber 13*d* of the introduction control valve 13.

A pressure port 28*a* is formed in the partition wall 28. The port 28*a* is opened and closed by the diaphragm 13*a*. The atmospheric pressure chamber 13*d* is connected to an atmosphere introducing passage 27. The diaphragm 13*a* is pressed against the opening of the pressure port 28*a* by a spring 13*c* located in the negative pressure chamber 13*b*. Normally, the spring 13*c* closes the introduction control valve 13.

A buffer valve 40 is located between the negative pressure chamber 13*b* and the purge line 8. The purge line 8 is connected with the negative pressure chamber 13*b* through the buffer valve 40. As shown in FIG. 2(*a*), the interior of the buffer valve 40 is divided into two pressure chambers 42, 43 by a partition wall 41. The pressure chamber 42 is connected to the negative pressure chamber 13*b*. The pressure chamber 43 is connected to the purge line 8. An orifice 44 is formed in the partition wall 41 to connect the chambers 42, 43 with each other. Also, a check valve 45 is located in the wall 41 to permit flow from the chamber 42 to the chamber 43. When the pressure in the chamber 43, or the pressure in the purge line 8, is higher than the pressure in the chamber 42, or the pressure in the negative pressure chamber 13*b*, the check valve 45 is closed and the pressure in the chamber 43 is transmitted to the chamber 42 by the orifice 44. Therefore, the pressure in the chamber 42 is gradually increased. The pressure in the chamber 43 becomes equal to the pressure in the chamber 43 after a certain time lag. When the pressure in the chamber 43, or the pressure in the purge line 8, is lower than the pressure in the chamber 42, or the pressure in the negative pressure chamber 13*b*, the check valve 45 is opened. Thus, the pressure in the chamber 42 is transmitted to the chamber 43 through the orifice 44 and the check valve 45. Accordingly, the pressure in the chamber 42 is rapidly decreased to match that of the chamber 43.

When the engine is running, negative pressure is created in the surge tank 9*a*. The negative pressure in the surge tank 9*a* purges fuel adsorbed in the canister 2 to the intake passage 9. At this time, the check valve 45 is opened. Therefore, the negative pressure Pn1 in the purge line 8 is quickly equalized with the negative pressure Pn2 in the negative pressure chamber 13*b*. When the force of the negative pressure Pn2 is more than the force of the spring 13*c*, the diaphragm 13*a* is separated from the opening of the atmosphere introducing passage 27, which opens the atmosphere introduction control valve 13. Accordingly, atmospheric air flows into auxiliary chamber 17 in the canister 2 through the passage 27 and the port 25. The atmospheric air causes fuel vapor adsorbed in the activated carbon adsorbents 19*a*, 19*b* to flow to the purge line 8. The fuel vapor is then purged to the surge tank 9*a*.

When testing for a malfunction, negative pressure is applied to the fuel tank 1. To monitor the pressure change in the fuel tank 1, the purge control valve 11 is closed and the pressure block valve 25*a* is opened such that the pressure in the tank 1 becomes equal to the atmospheric pressure. When the block valve 25*a* is opened, the negative pressure Pn1 in the purge line 8 and the negative pressure Pn2 in the negative pressure chamber 13*b* are the same, and the force based on the negative pressure Pn2 is greater than the force of the spring 13*c*. This greatly displaces the diaphragm 13*a* and widely opens the distal opening of the atmosphere introducing passage 27, which introduces a significant amount of atmospheric air through the passage 27. Accordingly, the pressure in the purge line 8 quickly increases toward the atmospheric pressure, thus the negative pressure Pn1 decreases (Negative pressures Pn1 and Pn2 are referred to in terms of their absolute values). At this time, the check valve 45 is closed. Thus, the negative pressure Pn1 of the purge line 8 is transmitted to the negative pressure chamber 13*b* through the orifice 44, which gradually decreases the negative pressure Pn2 in the negative pressure chamber 13*b*. Therefore, the pressure in the purge line 8 is quickly equalized with the atmospheric pressure.

An exposure port 29 is formed in the upper portion of the atmospheric control valve 14. The exposure port 29 is connected to the atmospheric pressure chamber 12*b* of the release control valve 12 to constantly expose the chamber 12*b* to the atmospheric pressure. A discharge port 26 is formed in the control valve 14. The discharge port 26 discharges air from which fuel has been removed by the canister 2. To improve the fuel vapor recovery efficiency, the discharge port 26 has substantially the same cross-sectional area as the breather passage 7. The distal opening of the discharge port 26 is opened and closed by the diaphragm 12*a* of the release control valve 12. The diaphragm 12*a* is urged against the opening of the port 26 by the force of a spring 12*c* located in the atmospheric pressure chamber 12*b*. Thus, as long as the pressure in the canister 2 is below a certain level, the release control valve 12 is closed.

When the fuel tank 1 is being filled, pressure is applied to the canister 2 through the breather passage 7, which increases the pressure in the pressure chamber 12*d* of the release control valve 12. When the difference between the pressure in the chamber 12*d* and the atmospheric pressure, which is applied to the chamber 12*b* through the exposure port 29, reaches a predetermined level, the release control valve 12 is opened. Accordingly, air, from which fuel vapor has been moved in the main and auxiliary chambers 16, 17, is discharged through the port 25 and the discharge port 26.

A hole 31 is formed in the upper wall of the fuel tank 1. A cylindrical breather pipe 32 is fixed to the hole 31 to form part of the breather passage 7. A float valve 33 is located in the lower portion of the breather pipe 32. The differential valve 5 is located above the fuel tank 1 to cover the upper opening of the breather pipe 32. The interior of the differential valve 5 is divided into two chambers by a diaphragm 5*a*. The upper chamber is a first chamber 5*b* and the lower chamber is a second chamber 5*c*. A spring 5*d* is located in the first chamber 5*b* to press the diaphragm 5*a* against the upper opening 7*a* of the breather passage 7, which is located in the second chamber 5*c*. The diaphragm 5*a* opens and closes the upper opening 7*a* of the breather passage 7.

A filler pipe 36 is connected to the fuel tank 1. The filler pipe 36 is connected to the first chamber 5*b* of the differential valve 5 by a pressure passage 34. A throttle 36*a* is formed in the lower end of the filler pipe 36. When fuel flows through the throttle 36*a*, fuel vapor in the filler pipe 36 flows only from an inlet 36*b* to the fuel tank 1. Thus, fuel vapor is prevented from being emitted to the outside. The upper portion of the fuel tank 1 is connected to the upper portion of the filler pipe 36 by a circulation line pipe 37. The pipe 37 circulates fuel vapor between the tank 1 and the filler pipe 36 when fuel is being supplied to the tank 1, which permits fuel to smoothly flow into the tank 1.

A pressure sensor 1*a* is located in the upper portion of the fuel tank 1 to detect the pressure in the fuel tank 1.

The pressure sensor 1*a* detects the pressure of the fuel tank 1 and spaces communicated with the fuel tank 1 in relation to the atmospheric pressure. That is, the pressure sensor 1*a* defines atmospheric pressure as zero. Signals from the pressure sensor 1*a* are sent to the ECU 10, which controls purging and malfunction testing. The ECU 10 also receives signals from other sensors such as an air flowmeter 9*c* located in the intake passage 9.

The above described fuel vapor purge system operates in the following manner.

Fuel in the tank 1 evaporates, which increases the pressure in the tank 1. When the pressure in the tank 1 reaches a predetermined value, fuel vapor flows from the tank 1 to the canister 2 through the fuel vapor passage 3. Therefore, fuel vapor flows into the canister 2 through the orifice 4*a* of the buffer chamber 4. In this case, the pressures in the first chamber 5*b* and the second chamber 5*c* of the differential valve 5 are equal. Therefore, the valve 5 is closed and the breather passage 7 is disconnected from the fuel tank 1.

Fuel vapor reaches the canister 2 through the passage 3. Fuel in the vapor is adsorbed by the activated carbon adsorbent 19*a* in the adsorbent layer 20*a* of the main chamber 16. Fuel vapor then flows to the diffusion chamber 21 through the layer 20*a*. Thereafter, the fuel vapor is guided to the auxiliary chamber 17. The remaining fuel in the vapor is adsorbed by the adsorbent layer 20*b* in the auxiliary chamber 17. In this manner, the fuel vapor flows along a U-shaped path in the canister 2, which extends the time during which the fuel vapor contacts the activated carbon adsorbents 19*a*, 19*b*. Fuel in the vapor is thus effectively removed.

Most of fuel in the fuel vapor is removed by the adsorbents 19*a*, 19*b* in the layers 20*a*, 20*b*. The gas then opens the release control valve 12 and is discharged to the outside through the discharge port 26. At this time, the pressure in the negative pressure chamber 13*b* of the atmosphere introduction control valve 13 is positive and higher than the pressure in the atmospheric pressure chamber 13*d*. Therefore, the control valve 13 is not opened. Thus, gas is not emitted to the outside through the control valve 13 and the introducing passage 27.

The fuel collected by the canister 2 is supplied to the intake passage 9 in the following manner. When the engine is started, the pressure in the vicinity of the opening of the purge line 8 in the surge tank 9*a* becomes negative. Every time the ECU 10 commands the purge control valve 11 to open, fuel vapor flows in the purge line 8 from the canister 2 to the surge tank 9*a*.

Therefore, the pressure in the canister 2 becomes negative. In this state, the control valve 13 is opened, which causes air to enter the auxiliary chamber 17 of the canister 2 through the introducing passage 27. Accordingly, fuel adsorbed in the activated carbon adsorbents 19*a*, 19*b* is separated from the adsorbents 19*a*, 19*b*.

In this manner, the fuel vapor is carried to the purge line 8 by the introduced air and is released into the surge tank 9*a* through the purge control valve 11. In the surge tank 9*a*, the fuel vapor is mixed with air drawn through an air cleaner 9*b*, the air flowmeter 9*c* and a throttle valve 9*d*, and is supplied to the cylinders (not shown). Together with fuel discharged by a fuel injector 39 through the fuel pump 38, fuel vapor in the intake air is burned in the cylinders.

When the vehicle is parked at one place for a relatively long period, the tank 1 is cooled and fuel vapor is no longer generated. When the pressure in the tank 1 is lower than the pressure in the canister 2, the pressure in the buffer chamber 4 is negative. Therefore, fuel vapor in the canister 2 is returned to the fuel tank 1 through the fuel vapor passage 3 and the orifice 4*a*.

Figure 3:
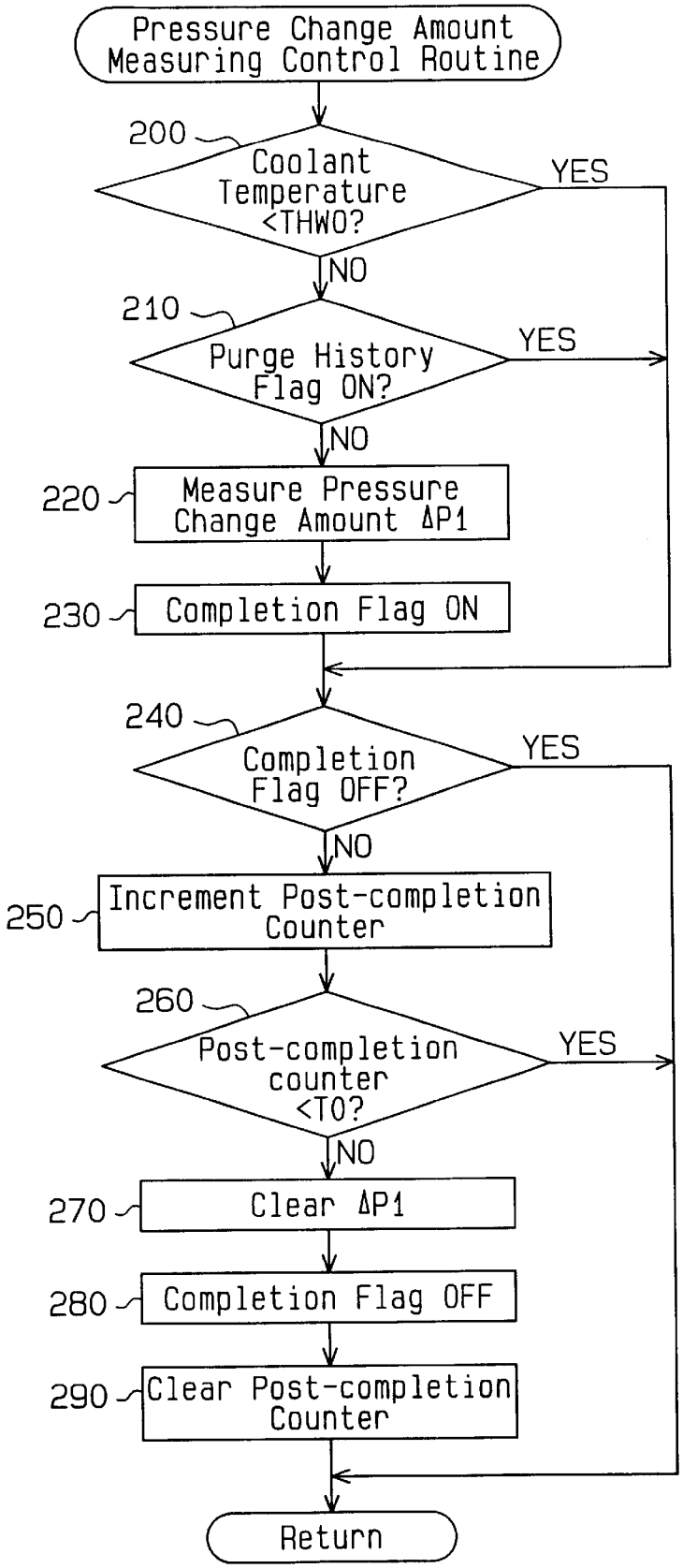
FIG. 3 is a flowchart illustrating a control routine for measuring pressure change executed by the ECU of the system shown in FIG. 1.
Figure 4:
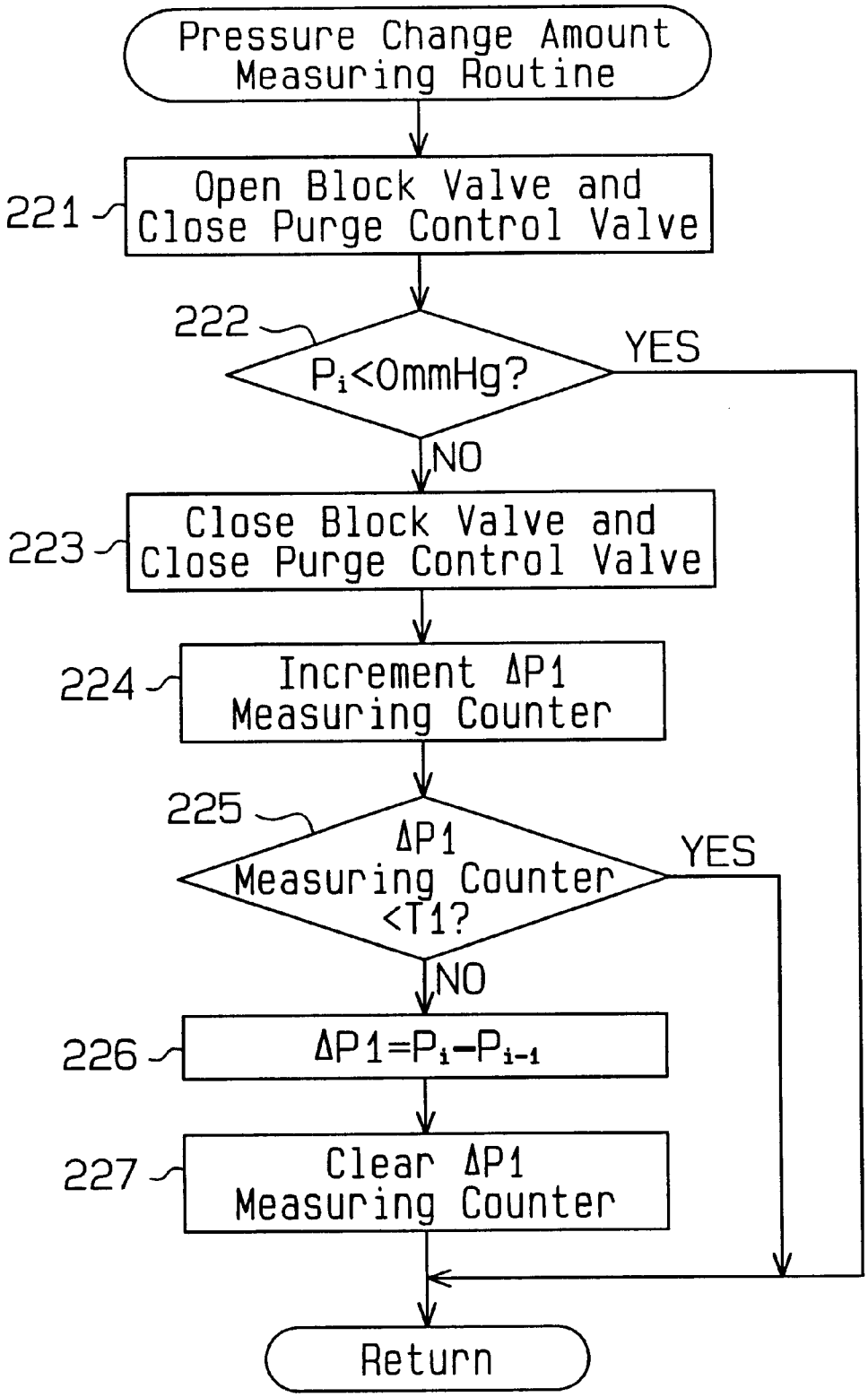
FIG. 4 is a flowchart illustrating a routine for measuring pressure change of the system shown in FIG. 1.
Figure 5:
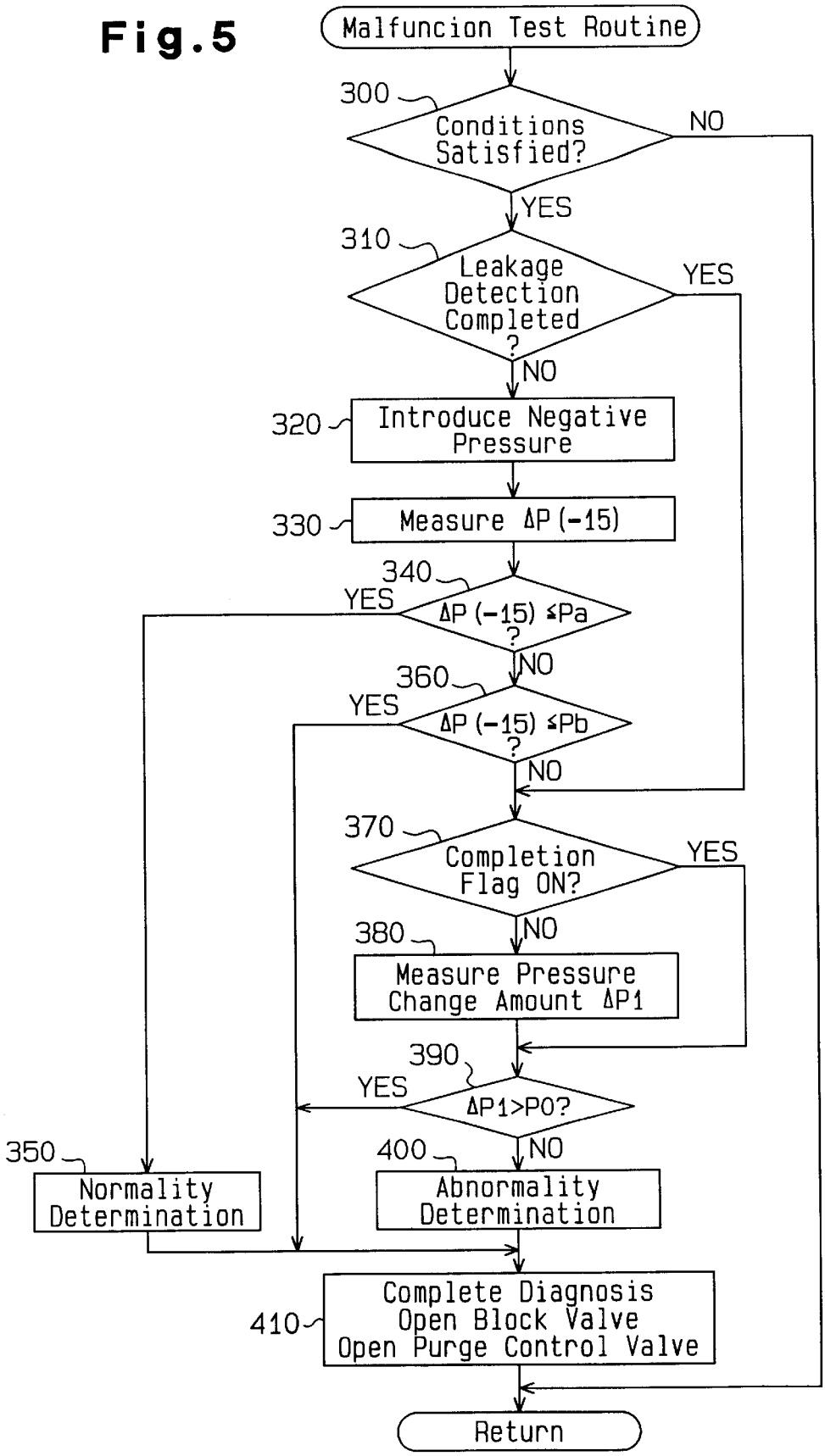
FIG. 5 is a flowchart illustrating a malfunction test routine according to the first embodiment.

Malfunction testing of the fuel vapor purge system performed by the ECU 10 will now be described. FIGS. 3 to 5 are flowcharts illustrating the malfunction test. One example of the procedure is illustrated in the timing charts of FIGS. 6 and 7.

Necessary initial settings for the testing procedure are completed after the ECU 10 is turned on. Thereafter, the testing procedure is performed when predetermined conditions are satisfied. When the conditions are satisfied, the fuel vapor purge system can be exposed to the intake negative pressure for testing. For example, if the pressure sensor 1*a* and other sensors are normally functioning, the conditions are satisfied when a certain period has elapsed after the engine is started and the engine speed is stable.

The flowchart of FIG. 3 illustrates a control routine for measuring pressure changes in the fuel tank 1. The ECU 10 executes this routine at predetermined intervals.

When the engine speed is stable, the ECU 10 judges whether the temperature of engine coolant is lower than a predetermined value THW0, which is for example, forty degrees centigrade, in step 200. If the coolant temperature lower than the value THW0, the ECU 10 moves to step 240. If the coolant temperature is equal to or higher than the value THW0, the ECU 10 moves to step 210.

In step 210, the ECU 10 judges whether a purge history flag is ON in the current trip. One trip refers to a period from when the engine is accelerated from an idling state to when the engine is back to an idling state. If the history flag is ON, the ECU 10 moves to step 240. If the history flag is OFF, that is, if purging has not been executed in the current trip after the engine is started, the ECU 10 moves step 220. In step 220, the ECU 10 measures a pressure change amount ΔP1 in the fuel tank 1.

The flowchart of FIG. 4 describes a routine of step 220 for measuring a pressure change in the fuel tank 1.

In step 221, the ECU 10 opens the block valve 25*a* and shuts the purge control valve 11. If the pressure in the fuel tank 1 is negative, the atmosphere introduction control valve 13 is opened and the atmospheric air enters the canister 2 and the fuel tank 1 through the introducing passage 27. Accordingly, the pressure in the fuel tank 1 is quickly increased to the atmospheric pressure.

In step 222, the ECU 10 judges whether the pressure $P_i$ of the fuel tank 1 detected by the pressure sensor 1*a* is lower than 0 kPa (0 mmHg), which is atmospheric pressure in this description. If the pressure $P_i$ is lower than 0 kPa, the ECU 10 temporarily suspends the current routine. If the pressure $P_i$ is higher than 0 kPa, the ECU 10 moves to step 223.

In step 223, the ECU 10 closes the block valve 25*a* and the purge control valve 11. In step 224, the ECU 10 increments a ΔP1 measuring counter.

Figure 6:
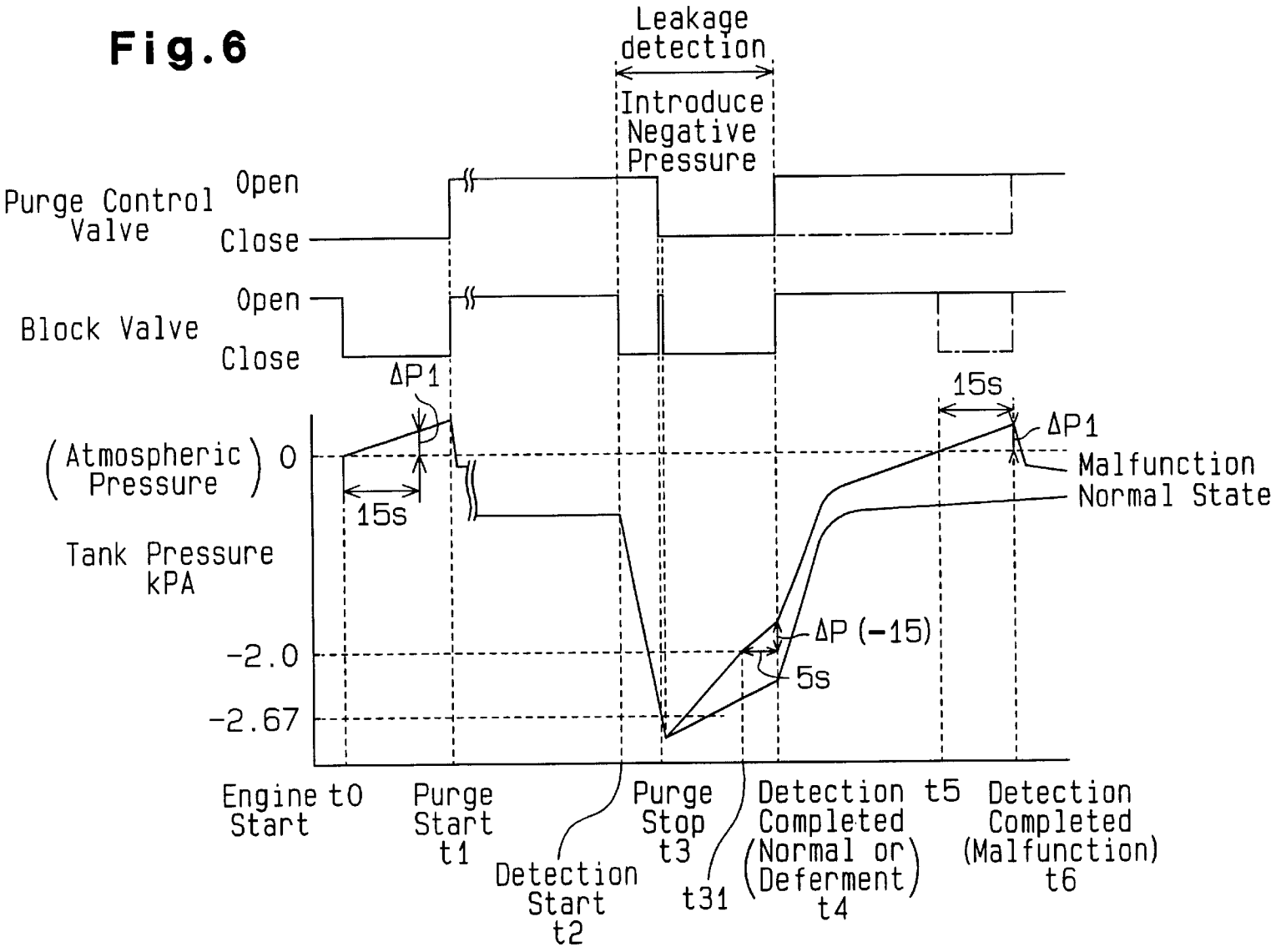
FIG. 6 is a timing chart showing a malfunction test executed by the system of FIG. 1.

FIG. 6 illustrates the state of the valves and changes of the pressure in the fuel tank 1 after the engine is started when the coolant temperature is equal to or lower than a predetermined temperature. The pressure in the tank 1 is maintained to 0 kPa until a certain period has elapsed after the engine is started, or until a time t0. After the time t0, the pressure in the tank 1 changes in accordance with the generation of fuel vapor.

In step 225, the ECU 10 determines whether the time measured by the ΔP1 measuring counter is less than a predetermined period T1, which is, for example, fifteen seconds. If the measured time is less than the period T1, the ECU 10 temporarily suspends the current routine. If the measured time is equal to or more than the period T1, the ECU 10 moves to step 226 and subtracts the pressure $P_{i-1}$ of the time period T1 earlier from the current pressure $P_i$. The resultant is defined as a pressure change amount ΔP1.

Therefore, as shown in FIG. 6, the pressure change amount ΔP1 in the fuel tank 1 is computed at a time t1. At the time t1, the block valve 25*a* and the purge control valve 11 are opened to initiate purging.

In step 227, the ECU 10 clears the ΔP1 measuring counter and terminates the current routine. The ECU 10 then moves to step 230. In step 230, the ECU 10 sets the ΔP1 measuring completion flag to ON. The value ON of the completion flag indicates that the measurement of ΔP1 is completed. The ECU 10 then moves to step 240.

In step 240, the ECU 10 determines whether the completion flag is OFF. If the flag is OFF, the ECU 10 temporarily suspends the current routine. If the flag is ON, the ECU 10 moves to step 250 and increments a post-completion counter.

In step 260, the ECU 10 determines whether the time measured by the post-completion counter is less than a predetermined period T0, which is, for example, three minutes. If the measured time is less than the period T0, the ECU 10 temporarily suspends the current routine. If the measured time is more than the period T0, the ECU 10 moves to step 270 and clears the pressure change amount ΔP1, which was measured in step 226.

In step 280, the ECU 10 sets the completion flag to OFF. In step 290, the ECU 10 clears the post-completion counter.

The flowchart of FIG. 5 illustrates a malfunction test routine for detecting a malfunction in the fuel vapor purge system. The ECU 10 executes this routine at predetermined intervals.

When entering this routine, the ECU 10 determines whether conditions for performing the test are satisfied in step 300. Specifically, the conditions are satisfied when the leakage test for the purge line has not been completed, purging is being executed, the altitude of the vehicle is equal to or below a certain height (for example 2400 m), or the atmospheric pressure is equal to or higher than a certain level, the coolant temperature when the engine is started is in a certain range, for example, between minus ten and plus thirty-five degrees centigrade, the vehicle is not moving uphill or downhill. The conditions are satisfied when all the listed conditions are satisfied.

If all the conditions are satisfied in step 300, the ECU 10 moves to step 310. If one or more conditions are not satisfied, the ECU 10 temporarily stops the current routine.

In step 310, the ECU 10 determines whether the leakage detection has been completed. If the decision outcome of step 310 is positive, the ECU 10 moves to step 370. If the decision outcome of step 310 is negative, the ECU 10 moves to step 320.

In step 320, the ECU 10 closes the block valve 25*a* and opens the purge control valve 11. Accordingly, outside air does not enter the purge system, and the canister 2 is exposed to the negative pressure in the surge tank 9*a* through the purge line 8. Also, the fuel tank 1 is exposed to the negative pressure through the canister 2, the orifice 4*a* and the fuel vapor passage 3.

Thus, as shown in FIG. 6, the purge system is exposed to negative pressure at time t2. Thereafter, the pressure detected by the pressure sensor 1*a* falls rapidly. At time t3, the purge control valve 11 is temporarily closed, which maintains the negative pressure in the purge line 8. If there is no malfunction, or leakage, the pressure in the purge system is increased by vaporization of fuel in the tank 1 and finally approaches a pressure at which the air and fuel vapor in the purge system reach equilibrium. However, if there is a leak in the purge system, the pressure in the purge system rapidly approaches atmospheric pressure.

In step 330, the ECU 10 measures the rate of pressure change (mmHg/second or kPa/second) at time t31, or when the pressure in the purge passage reaches a predetermined level (−2.0 kPa=−15 mmHg). The pressure change rate at the time 31 is represented by ΔP(−15).

In step 340, the ECU 10 determines whether the measured pressure change rate ΔP(−15) is equal to or less than a normality determination value Pa. If the rate ΔP(−15) is equal to or less than the value Pa, the ECU 10 moves to step 350. If the rate ΔP(−15) is more than the value Pa, the ECU 10 moves to step 360. In step 350, the ECU 10 determines that there is no leakage and moves to the step 410.

In step 360, the ECU 10 determines whether the rate ΔP(−15) is equal to or less than a malfunction determination value Pb. If the rate ΔP(−15) is equal to or less than the value Pb, the ECU 10 moves to step 410 without judging whether there is a malfunction. If the rate ΔP(−15) is more than the value Pb, the ECU 10 moves to step 370.

In step 370, the ECU 10 determines whether the ΔP measurement completion flag is ON. If the flag is ON, the ECU 10 moves to step 390. If the flag is OFF in step 370, the ECU 10 moves to step 380.

In step 380, the ECU 10 measures the pressure change amount ΔP1 as in step 220. As shown in FIG. 6, the pressure in the tank 1 increases above 0 KPa (0 mmHg) at time t5 due to vaporization of fuel. At time t6, the ECU 10 computes the pressure change amount ΔP1 in the tank 1.

In step 390, the ECU 10 determines whether the pressure change amount ΔP1 is more than a value P0, which is for example 0.27 kPa, or 2 mmHg. Step 390 is executed to determine the cause of the pressure increase. That is, the ECU 10 determines whether the pressure change amount ΔP1 is more than the value Pb because of leakage in the purge passage or because of an excessive amount of vaporization in the fuel tank 1. If the pressure change amount ΔP1 is more than the value P0 in step 390, the ECU 10 moves to step 410 without determining whether there is a malfunction. If the pressure change amount ΔP1 is equal to or less than the value P0, the ECU 10 moves to step 400.

In step 400, the ECU 10 determines that there is a leak and moves to step 410. The ECU 10 terminates the leakage test in step 410. At time t6, the ECU 10 opens the block valve 25*a*. The ECU 10 also opens the purge control valve 11 to start purging.

When measuring the pressure change amount ΔP1 in step 380, the ECU 10 opens the block valve 25*a* at the time t4 while maintaining the purge control valve 11 closed, which equalizes the tank pressure with the atmospheric pressure.

When the block valve 25*a* is opened, the negative pressure Pn1 in the purge line 8 is equal to the negative pressure Pn2 in the negative pressure chamber 13*b* and the force based on the negative pressure Pn2 is more than the force of the spring 13*c*. Accordingly, the diaphragm 13*a* is greatly displaced to increase the opening size of the introducing passage 27 and a great amount of atmospheric air flows into the passage 27. This rapidly increases the pressure in the purge line 8 and the negative pressure Pn1 is decreased. At this time, the check valve 45 is closed, which gradually decreases the negative pressure Pn2 in the negative pressure chamber 13*b*. The force of the negative pressure Pn2 eventually becomes less than the force of the spring 13*c* at a time t4*b*, and the control valve 13 is closed. In this manner, the pressure in the purge line 8 is quickly equalized with atmospheric pressure in a short period from the time t4 to the time t5.

Figure 7:
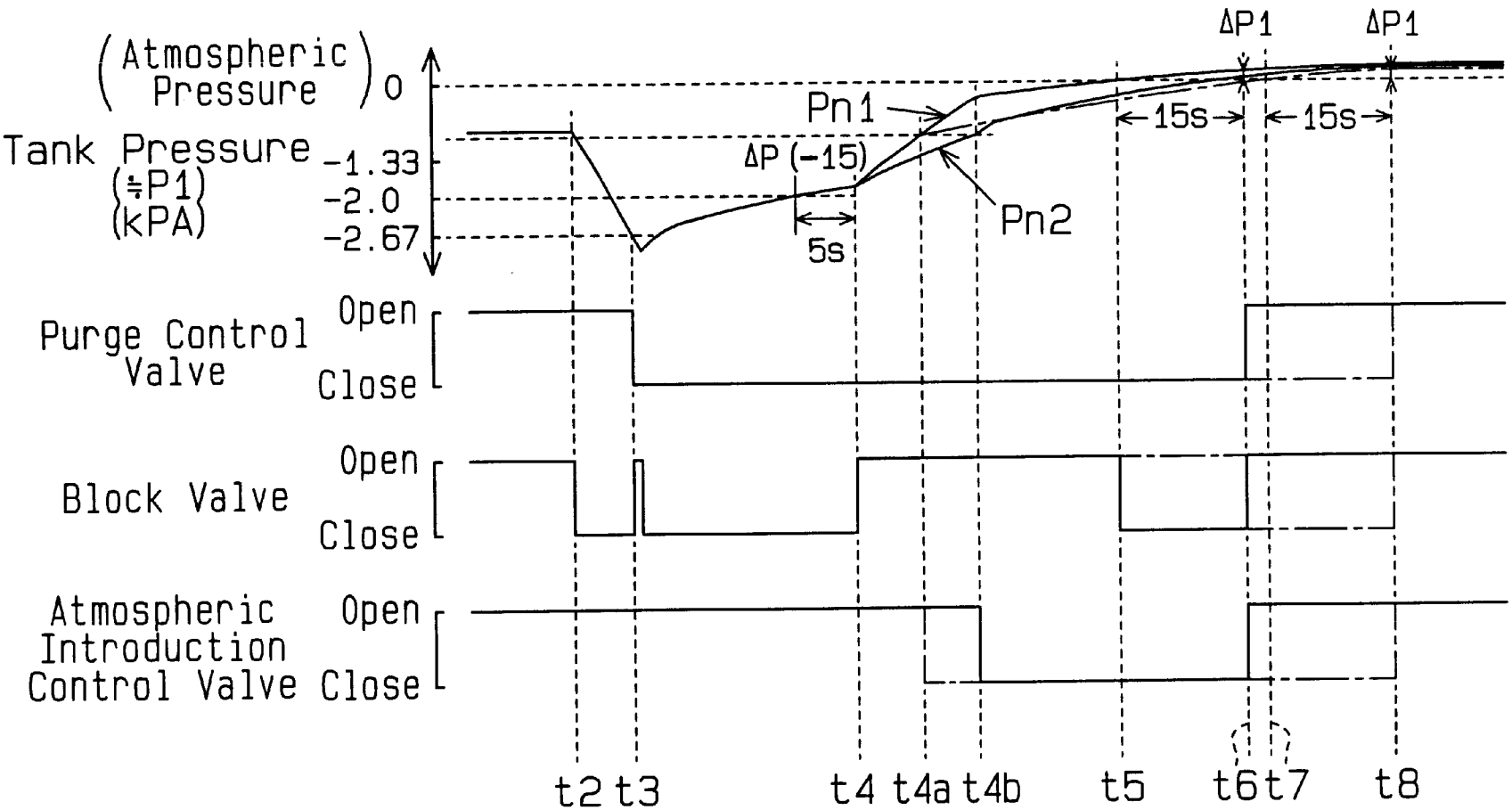
FIG. 7 is a timing chart showing a malfunction test executed by the system of FIG. 1.

If the introduction control valve 13 is directly connected to the purge line 8, the pressure in the fuel tank 1 changes as illustrated by a broken line in FIG. 7. In this case, the negative pressure in the purge line 8 changes in the same manner as the negative pressure in the negative pressure chamber 82*b*. The force of the negative pressure Pn2 becomes less than the force of the spring 82*c* at a time t4*a*, which is later than the time t4. The control valve 82 is closed at the time t4*a*. Therefore, it takes a relatively long time, or from the time t4 to the time t7, for the pressure in the purge line 8 to be equalized with the atmospheric pressure.

This embodiment has the following advantages.

If the pressure change rate ΔP1(−15) is greater than the malfunction determination value Pb in step 360, and the pressure change amount ΔP has been measured within the predetermined time T0 (for example, three minutes) before the malfunction test is started, the malfunction test can be performed by using the pressure change amount ΔP Therefore, the pressure change amount ΔP1 need not be measured after the malfunction test, which reduces the time required for the malfunction test. Since the pressure change amount ΔP1 need not be measured, purging is not stopped for a significantly long time, which allows sufficient purging of the fuel vapor in the canister 2.

In this embodiment, the fuel tank 1 is connected to the canister 2 through the orifice 4*a*, which constantly equalizes the pressure in the tank 1 with the pressure in the canister 2. Therefore, when testing the purge system and when the pressure change amount ΔP1 in the tank 1 is measured, the tank 1 and the canister 2 are connected in the same manner. Thus, when the pressure change rate ΔP(−15) is equal to or less than the value Pa in step 340, the malfunction test need not be continued. Also, the pressure change amount ΔP1 need not be measured again, which reduces the time required for testing. Further, since the pressure change amount ΔP1 need not be measured, purging is not stopped for a significantly long time, which allows sufficient purging of the fuel vapor in the canister 2.

When measuring the pressure change amount ΔP1, the pressure increase in the negative pressure chamber 13*b* is delayed by the buffer valve 40 relative to the pressure increase in the purge line 8, which extends the opening time of the introduction control valve 13. Accordingly, the pressure in the fuel tank 1 and the pressure in the canister 2 are rapidly increased to atmospheric pressure, which reduces the time required for the test of the purge system. As a result, the purging time is extended.

Figure 8:
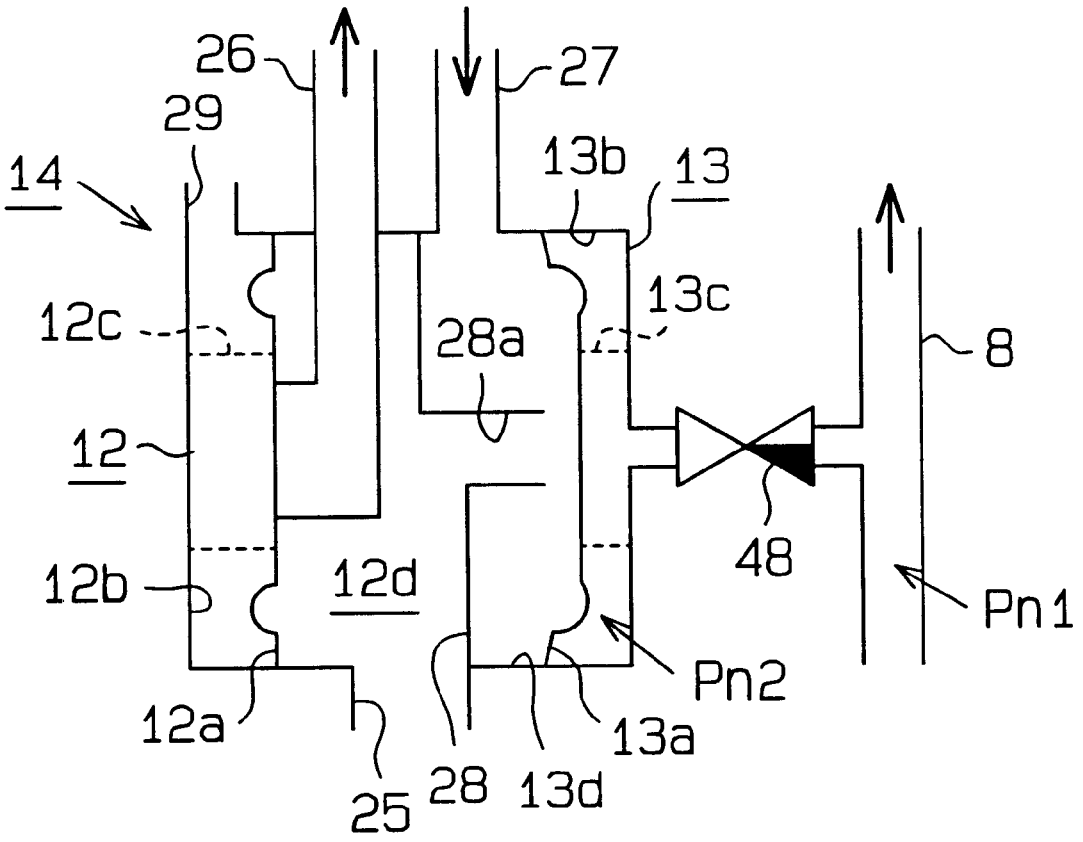
FIG. 8 is a diagrammatic view showing an atmospheric control valve according to a second embodiment.

A second embodiment of the present invention will now be described with reference to FIGS. 8 and 9. Like or the same reference numerals are given to those components that are like or the same as the corresponding components of the first embodiment. The differences from the first embodiment will mainly be discussed below.

Instead of the pressure buffer valve 40, which connects the introduction control valve 13 with the purge line 8, an introduction control valve 48, which is vacuum switching valve (VSV), is used. Otherwise, the construction is the same as that of the first embodiment.

Normally, the control valve 48 is open. The valve 48 is closed based on a control signal from the ECU 10 when the pressure in the fuel tank 1 is equalized with the atmospheric pressure for measuring the amount of fuel vapor in the tank 1 based on the pressure change amount ΔP1.

Accordingly, the purge line 8 is disconnected from the negative pressure chamber 13*b* of the control valve 13. As a result, the negative pressure Pn2 of the negative pressure chamber 13*b* is maintained regardless of changes of the pressure in the purge line 8.

When measuring the pressure change amount ΔP1 in the fuel tank 1, the ECU 10 opens the block valve 25*a* at the time t4 while maintaining the purge control valve 11 closed, which increases the fuel tank pressure to the atmospheric pressure. At this time, the ECU 10 closes the control valve 48 to disconnect the purge line 8 from the negative pressure chamber 13*b* to maintain the negative pressure Pn2 in the negative pressure chamber 13*b* regardless of changes in the pressure in the purge line 8. When the block valve 25*a* is opened, the negative pressure Pn1 in the purge line 8 is equal to the negative pressure Pn2 in the negative pressure chamber 13*b*, and the force based on the negative pressure Pn2 is more than the force of the spring 13*c*, which greatly displaces the diaphragm 13*a*. This widely opens the distal opening of the introducing passage 27 and a great amount of atmospheric air enters the passage 27. Therefore, the pressure in the purge line 8 rapidly increases to atmospheric pressure and the negative pressure Pn1 is decreased. At this time, the negative pressure Pn2 in the negative pressure chamber 13*b* is maintained. The control valve 48 is opened at a time t4*c*, or when the pressure in the fuel tank 1 reaches atmospheric pressure. Therefore, it takes a short period, from the time t4 to the time t4*c*, for the pressure in the purge line 8 to reach atmospheric pressure. The time t4*c* is earlier than the time t5.

Figure 9:
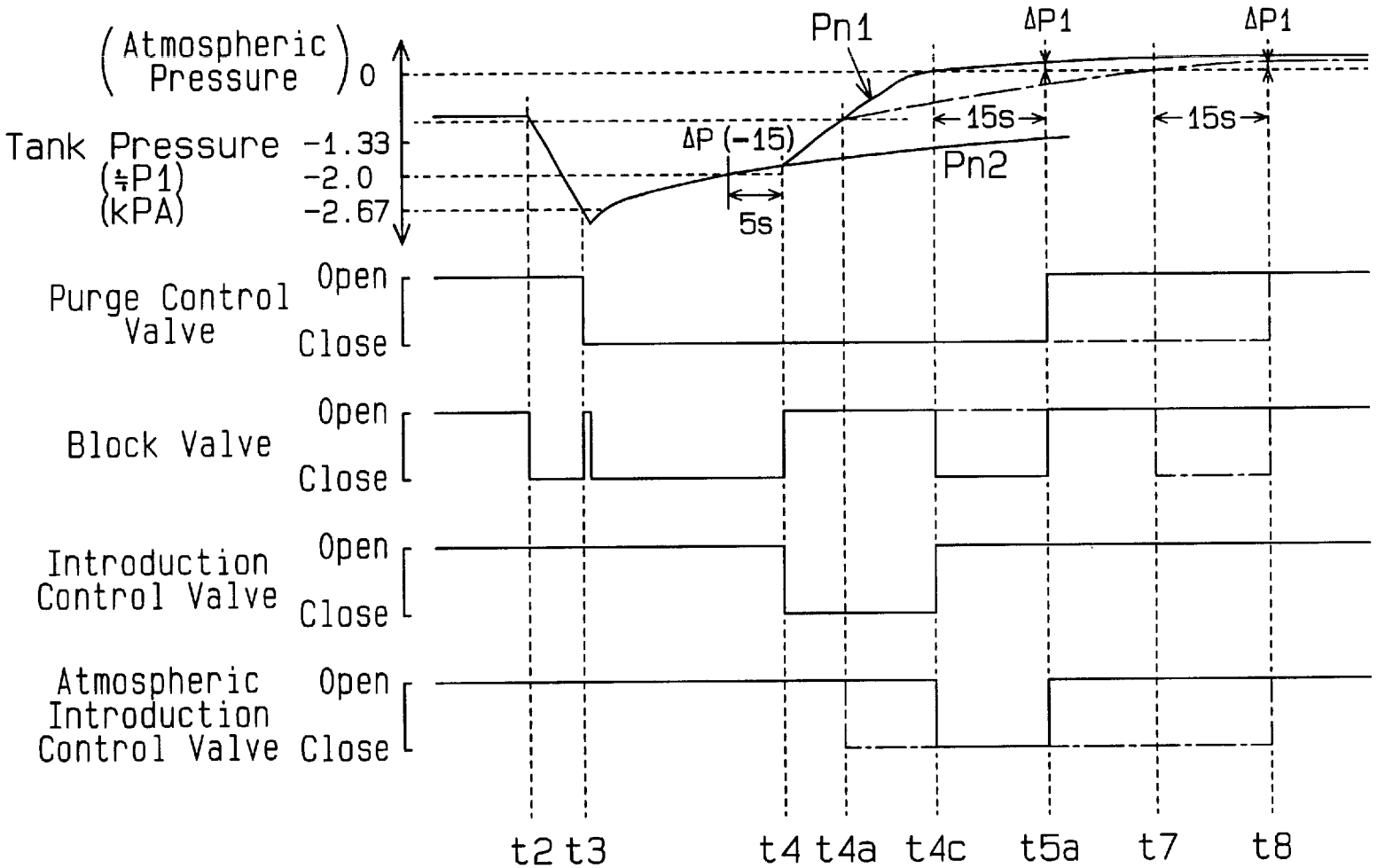
FIG. 9 is a timing chart showing a malfunction test according to the second embodiment.

If the introduction control valve 13 is directly connected to the purge line 8, the pressure in the fuel tank 1 changes as illustrated by a broken line in FIG. 9.

In addition to the advantages of the first embodiment, the second embodiment has the following advantages. That is, since the introduction control valve 13 is open for a relatively long period, the pressure in the fuel tank 1 and the pressure in the canister 2 are rapidly increased to atmospheric pressure compared to the first embodiment, which the buffer valve 40 is used. This reduces the time required for testing the purge system. As a result, the purging time is extended.

Figure 10:
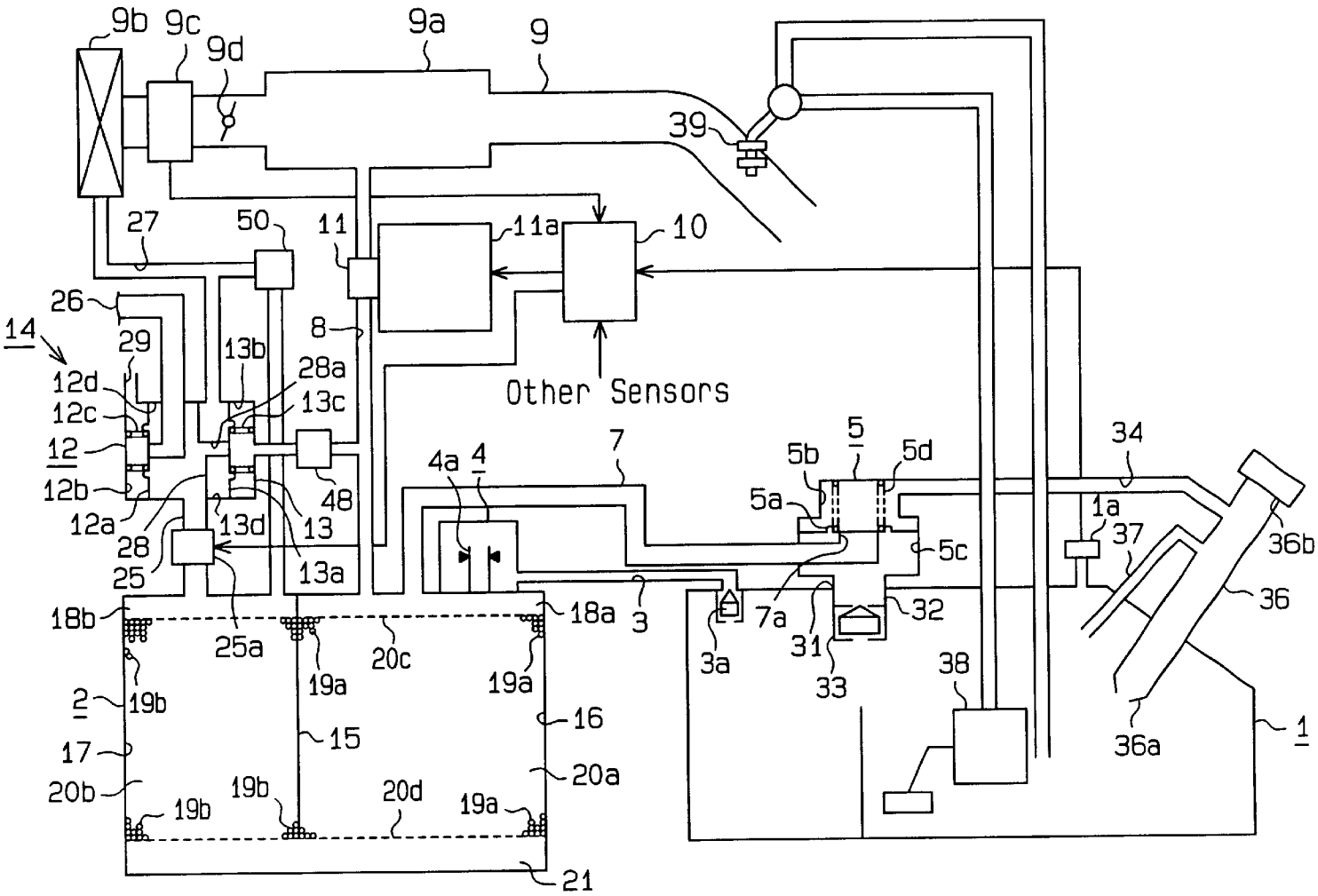
FIG. 10 is a diagrammatic view illustrating a fuel vapor purge system according to a third embodiment.

A third embodiment of the present invention will now be described with reference to FIGS. 10 to 12. Like or the same reference numerals are given to those components that are like or the same as the corresponding components of the first embodiment. The differences from the second embodiment will mainly be discussed below.

The purge system of the third embodiment is the same as that of the second embodiment except that an inner pressure control valve 50 is located between the introducing passage 27 and the auxiliary chamber 17. The control valve 50 bypasses the introduction control valve 13.

Figure 11:
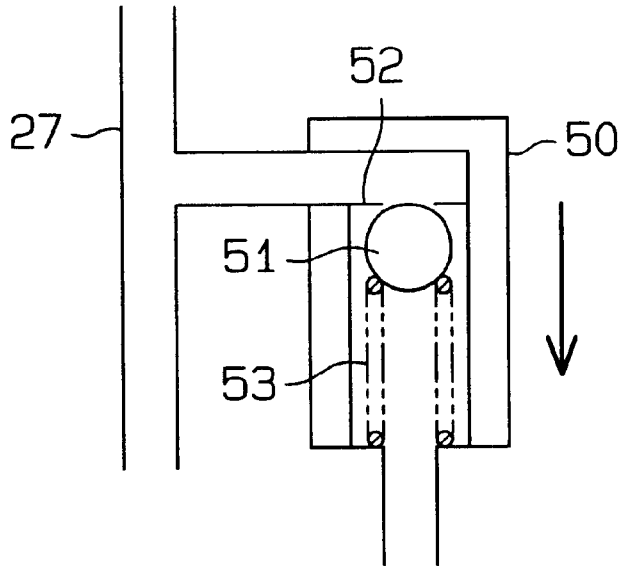
FIG. 11 is a diagrammatic view showing an internal pressure control valve according to the third embodiment.
Figure 12:
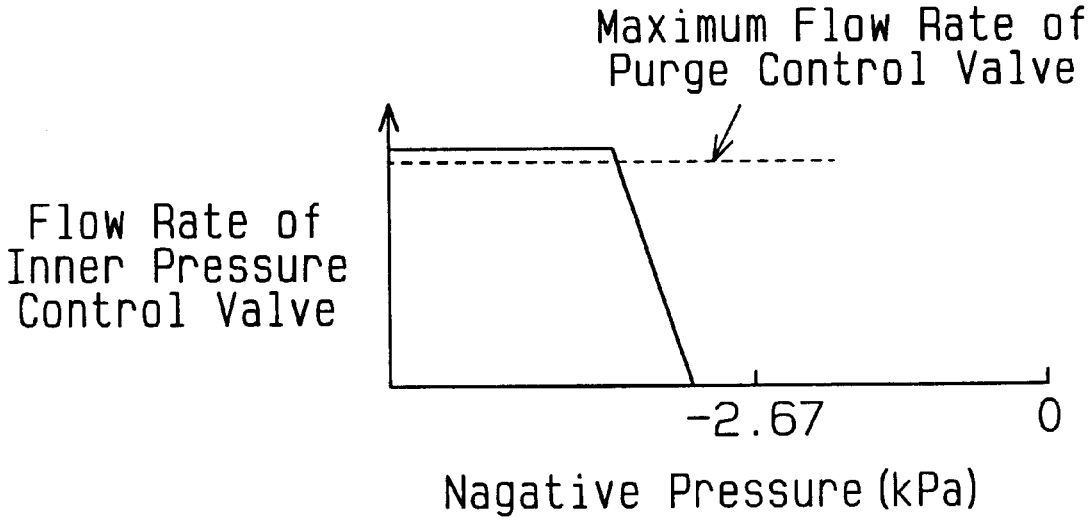
FIG. 12 is a graph showing the relationship between a negative pressure and the amount of the atmospheric air entering the internal pressure control valve.

As shown in FIG. 11, the control valve 50 includes a check ball 51, which is located downstream of the flow of the atmospheric air. The check ball 51 is urged by a spring 53 and contacts a vale seat 52. The force of the spring 53 is slightly more than the force generated by a target negative pressure when testing for a malfunction, which is, for example, −2.67 kPa, or −20 mmHg. When opened, the valve 50 permits air to flow therethrough and the amount of the air is equal to or more than the maximum airflow of the purge control valve 11 (see FIG. 12).

If the control valve 48 malfunctions and cannot be opened, the negative pressure chamber 13*b* is not exposed to the negative pressure Pn1 in the purge line 8 when purging is being performed, which holds the valve 13 closed. Accordingly, the negative pressure in the tank 1 and the negative pressure in the canister 2 become excessive. This may collapse the fuel tank 1 and the canister 2. However, according to the third embodiment, if the negative pressure in the fuel tank 1 is equal to or greater than the target negative pressure, the control valve 50 is opened to draw atmospheric air into the canister 2. Therefore, the fuel tank 1 and the canister 2 do not collapse.

The purge system of the third embodiment has the same advantages of the purge system according to the second embodiment.

Figure 13:
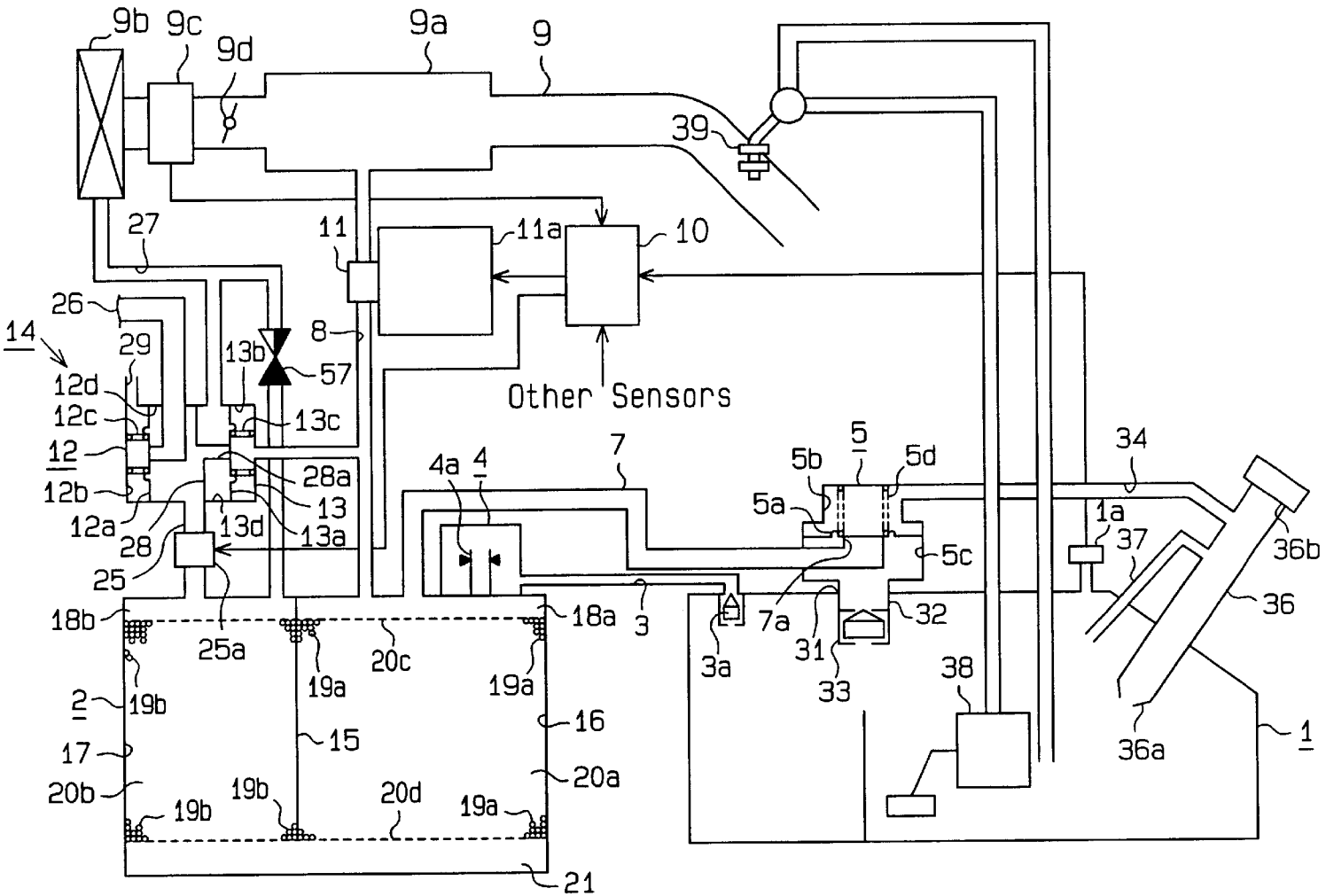
FIG. 13 is a diagrammatic view illustrating a fuel vapor purge system according to a fourth embodiment.

A fourth embodiment of the present invention will now be described with reference to FIGS. 13 and 14. Like or the same reference numerals are given to those components that are like or the same as the corresponding components of the first embodiment. The differences from the second embodiment will mainly be discussed below.

The purge system of the fourth embodiment is the same as that of the second embodiment except that the control valve 48 between the control valve 13 and the purge line 8 is omitted. The control valve 13 is directly connected to the purge line 8. Also, the purge system of the fourth embodiment has an introduction control valve 57, which is a vacuum switching valve (VSV). The control valve 57 bypasses the introduction control valve 13.

The control valve 57 is normally closed. The control valve 57 is opened based on control signals from the ECU 10 when the pressure in the fuel tank 1 is equalized with atmospheric pressure for measuring the pressure change amount ΔP1.

Figure 14:
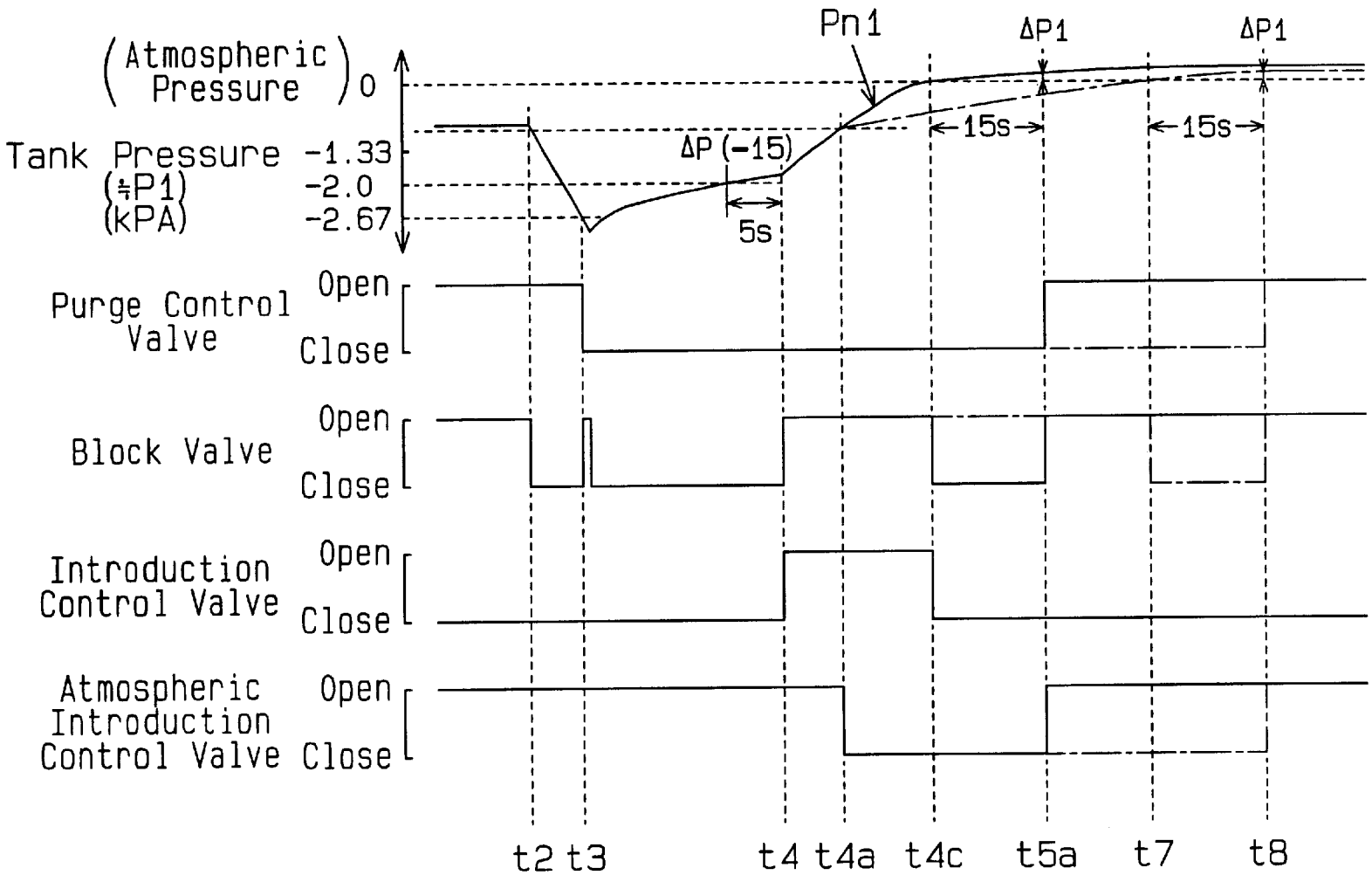
FIG. 14 is a timing chart showing a malfunction test according to the fourth embodiment.

Therefore, when measuring the pressure change amount ΔP1, the ECU 10 opens the block valve 25*a* at a time t4 in FIG. 14, while keeping the purge control valve 11 closed. Accordingly, the pressure in the fuel tank 1 is equalized with atmospheric pressure. At this time, the introduction control valve 57 is opened, which permits a great amount of atmospheric air to enter the canister 2 through the introducing passage 27. Thus, the pressure in the purge line 8 rapidly approaches atmospheric pressure, which decreases the negative pressure Pn1. The pressure in the fuel tank 1 reaches atmospheric pressure at a time t4*c*. At the time t4*c*, the control valve 57 is closed. Therefore, it only takes a short period from the time t4 to t4*c* for the pressure in the purge line 8 to reach the atmospheric pressure. The time t4*c* is earlier than the time t5.

If the introduction control valve 13 is directly connected to the purge line 8, the pressure in the fuel tank 1 changes as illustrated by a broken line in FIG. 14.

According to the fourth embodiment, the control valve 57 is opened when measuring the pressure change amount ΔP1 in the fuel tank 1 during the malfunction test. Thus, a great amount of atmospheric air is drawn into the canister 2, which rapidly increases the pressure in the fuel tank 1 and the pressure in the canister 2 to the atmospheric pressure. This reduces the time required for testing the purge system. As a result, the purging time is extended.

Figure 15:
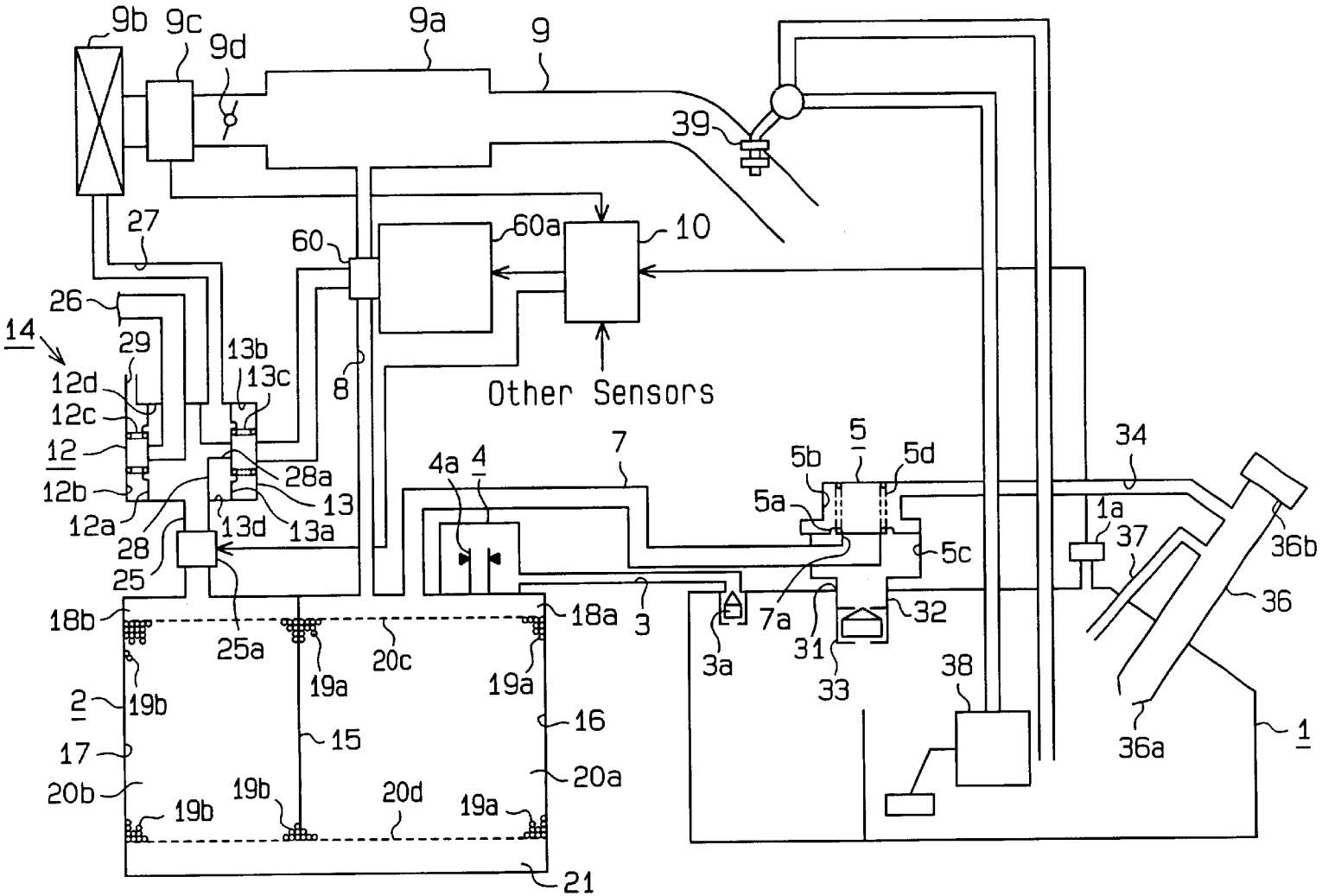
FIG. 15 is a diagrammatic view illustrating a fuel vapor purge system according to a fifth embodiment.
Figure 16:
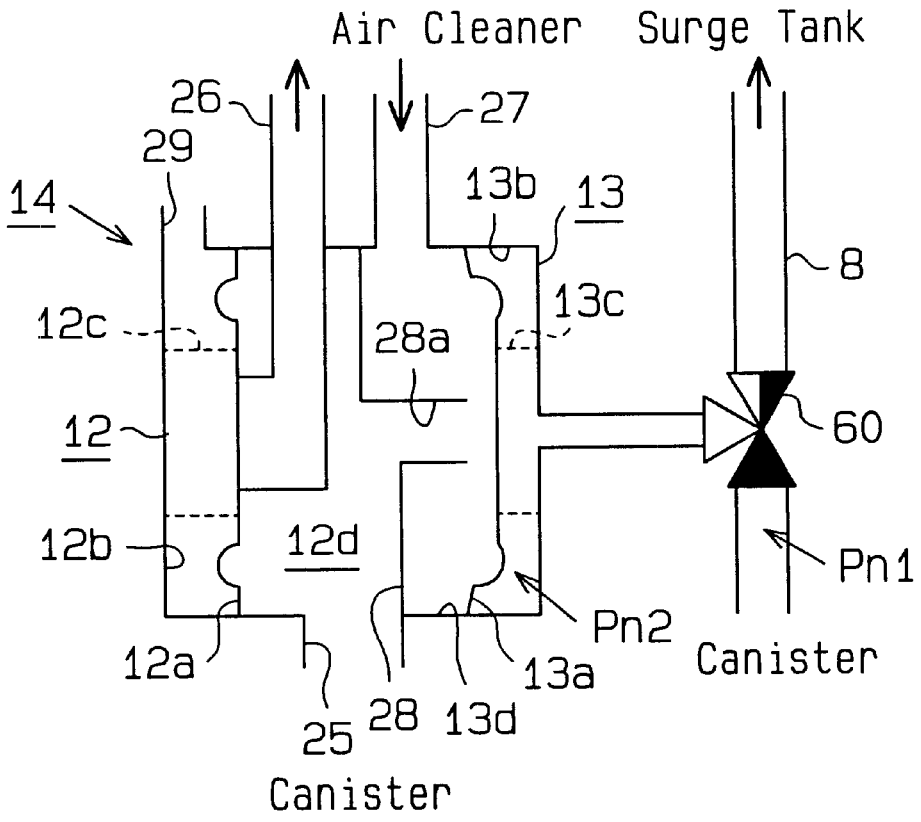
FIG. 16 is a diagrammatic view showing an atmospheric control valve according to the fifth embodiment.
Figure 20:
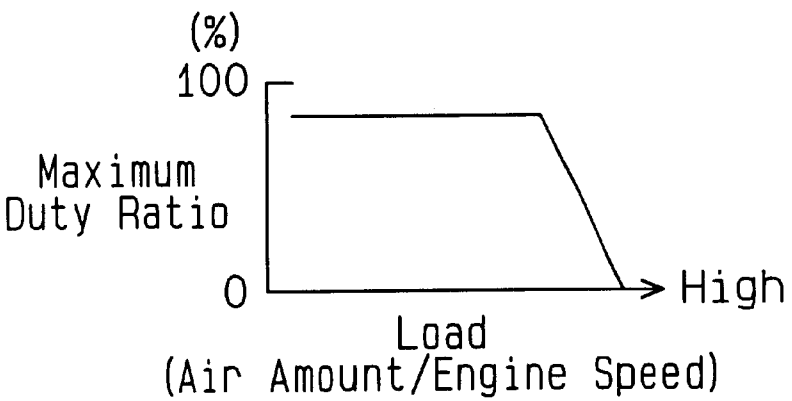
FIG. 20 is a graph showing the relationship between the engine load and the maximum duty guard of a signal sent to the purge control valve according to the fifth embodiment.

A fifth embodiment of the present invention will now be described with reference to FIGS. 15 and 20. Like or the same reference numerals are given to those components that are like or the same as the corresponding components of the purge system of FIG. 1. The differences from the second embodiment will mainly be discussed below.

The purge system of the fifth embodiment is the same as that of the second embodiment except that the control valve 48 between the control valve 13 and the purge line 8 is omitted. The purge system of the fifth embodiment has a three-way valve 60. One of the ports of the valve 60 is connected to the negative pressure chamber 13*b*.

During purging, the three-way valve 60 is controlled based on signals from the ECU 10. Specifically, the ECU 10 transmits a signal having a predetermined duty ratio to the valve 60. When the signal from the ECU 10 is an OFF signal, the valve 60 connects the surge tank 9*a* with the negative pressure chamber 13*b* of the control vale 13 through the purge line 8 and disconnects the canister 2 from the surge tank 9*a*. Accordingly, the negative pressure chamber 13*b* is exposed to the negative pressure in the surge tank 9*a*. When the signal from the ECU 10 is an ON signal, the valve 60 connects the canister 2 with the surge tank 9*a* through the purge line 8 and disconnects the negative pressure chamber 13*b* from the surge tank 9*a*. If the force of the negative pressure Pn2 in the chamber 13*b* is greater than the force of the spring 13*c*, the diaphragm 13*a* is greatly displaced, which widely opens the distal opening of the passage 27. Thus, the atmospheric air enters the passage 27, which executes purging.

When measuring the pressure change amount ΔP1 in the fuel tank 1, the ECU 10 opens the block valve 25*a* at the time t4, while keeping the purge control valve 60 closed, which increases the fuel tank pressure to atmospheric pressure. At this time, the ECU 10 connects the negative pressure chamber 13*b* to the surge tank 9*a* to expose the chamber 13*b* to the negative pressure of the surge tank 9*a*. This greatly displaces the diaphragm 13*a* and widely opens the distal opening of the passage 27. Accordingly, a great amount of air enters the passage 27, which rapidly increases the pressure in the purge line 8 and decreases the negative pressure Pn1. The ECU 10 opens the purge control valve 60 at a time t5, which is a predetermined period (fifteen seconds) after the fuel tank pressure reaches the atmospheric pressure. Therefore, it takes a short period from the time t4 to the time t4*c* for the pressure in the purge line 8 to reach atmospheric pressure.

Figure 18:
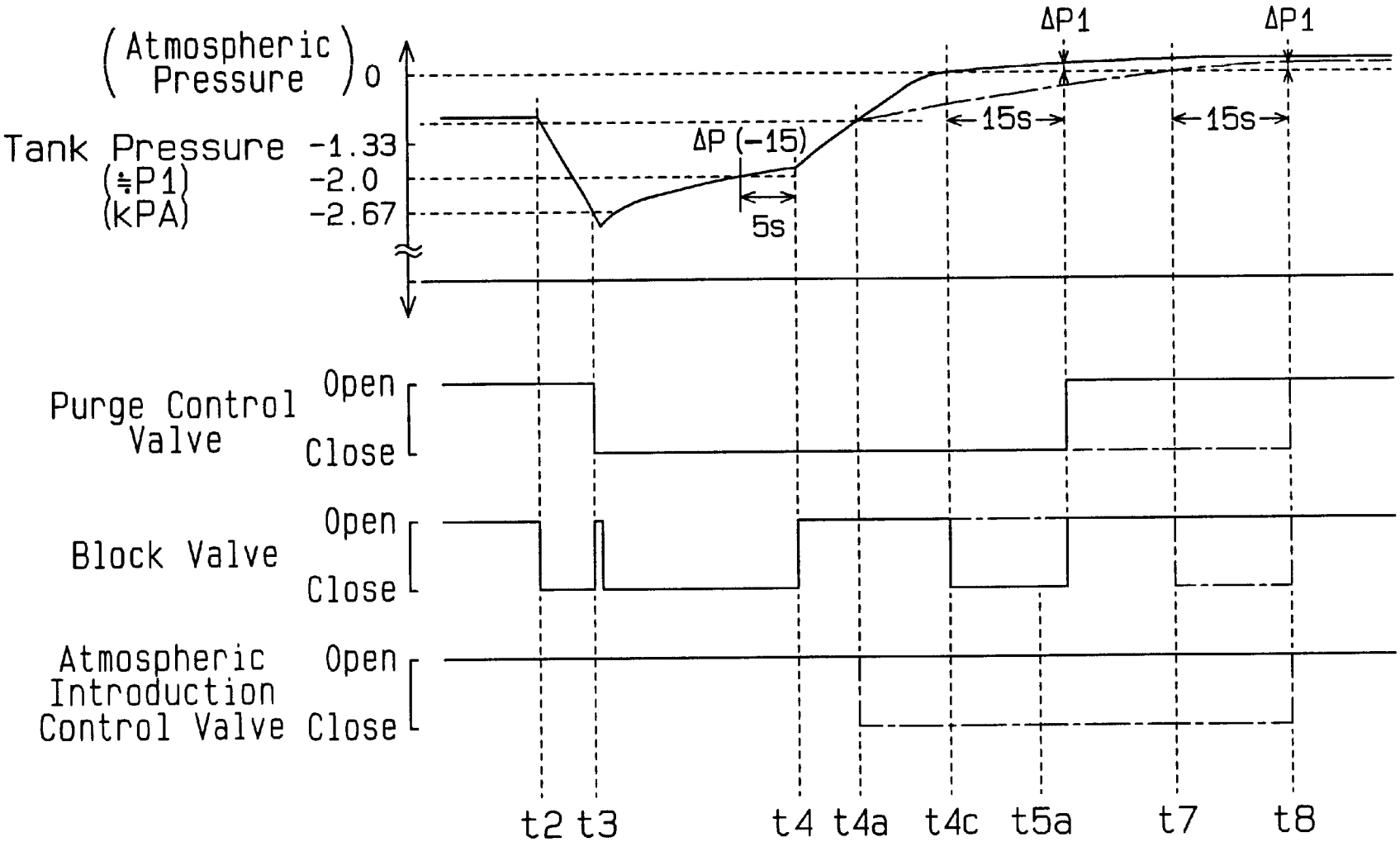
FIG. 18 is a timing chart showing a malfunction test according to the fifth embodiment.

If the introduction control valve 13 is directly connected to the purge line 8, the pressure in the fuel tank 1 changes as illustrated by a broken line in FIG. 18.

Thus, when there is no leakage between the negative pressure chamber 13*b* and the purge control valve 60, the negative pressure in the chamber 13*b* is maintained and the introduction control valve 13 is opened to execute purging. Therefore, the duty ratio of the signal from the ECU 10 can be raised to 100%.

A greater duty ratio of a signal from the ECU 10 represents a shorter OFF time of the purge control valve 60. Therefore, if there is a little leakage between the chamber 13*b* and the purge control valve 60, a greater duty ratio of the signal from the ECU 10 prevents the chamber 13*b* from receiving sufficient negative pressure. As a result, the negative pressure in the chamber 13*b* is decreased and the pressure in the purge line 8 is rapidly increased toward atmospheric pressure. This may close the introduction control valve 13. If the valve 13 is closed, purging cannot be executed, which may collapse the canister 2 and the fuel tank 1.

Figure 17:
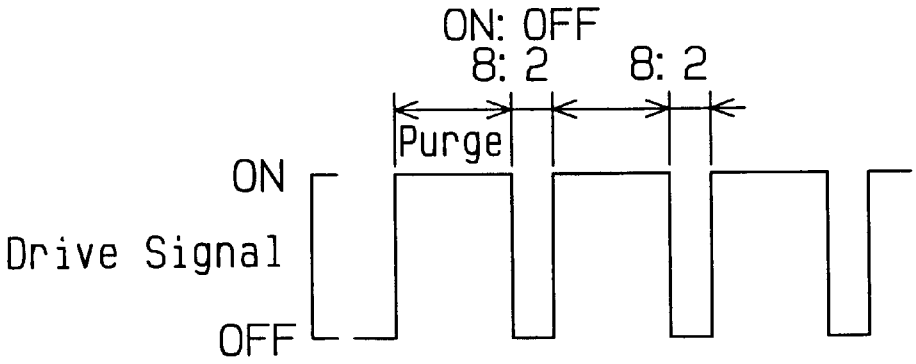
FIG. 17 is a timing chart showing an example of a drive signal sent to a purge control valve according to the fifth embodiment.

Therefore, as shown in FIG. 17, the maximum value of the duty ratio may set to, for example, 80%. This will permit the negative pressure chamber 13*b* to be exposed to the negative pressure of the surge tank 9*a* during OFF times, which are 20%. In this case, the duty ratio of the control valve 60 cannot be increased to 100% and the control valve 60 cannot execute purging by the maximum flow rate. Thus, a relatively large valve is preferred to be used as the control valve 60.

Figure 19:
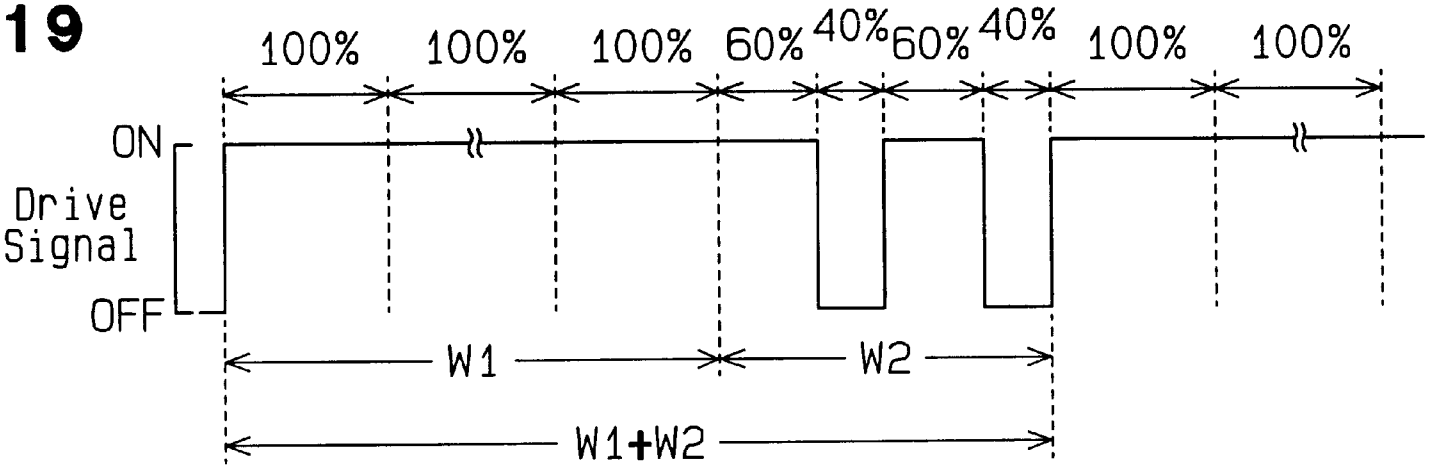
FIG. 19 is a timing chart showing an example of a drive signal sent to the purge control valve according to the fifth embodiment.

If the purge control valve 60 is controlled by a duty ratio equal to or more than 90%, two different cycles W1 and W2 of the duty ratio may be alternately executed as shown in FIG. 19. Specifically, the duty ratio is 100% in the cycle W1 and the duty ratio is 60% in the cycle W2. In this case, purging is temporarily executed by the maximum flow rate of the purge control valve 60. Therefore, the control valve 60 need not be replaced with a valve having a greater flow rate.

In general, a higher engine load represents a smaller negative pressure (a higher pressure) in the surge tank 9*a*. Therefore, when setting a maximum value of duty ratio, the OFF times must be extended to generate the needed negative pressure in the negative pressure chamber 13*b*. Thus, as shown in FIG. 20, the maximum duty ratio may be decreased as the engine load is increased. When alternating the duty ratio between two different cycles W1, W2 as shown in FIG. 19, the cycle W2 may be repeatedly executed for a certain period. This compensates for lack of negative pressure in the surge tank 9*a*.

The purge system according to the fifth embodiment has the same advantages as the purge system of the second embodiment.

Figure 21:
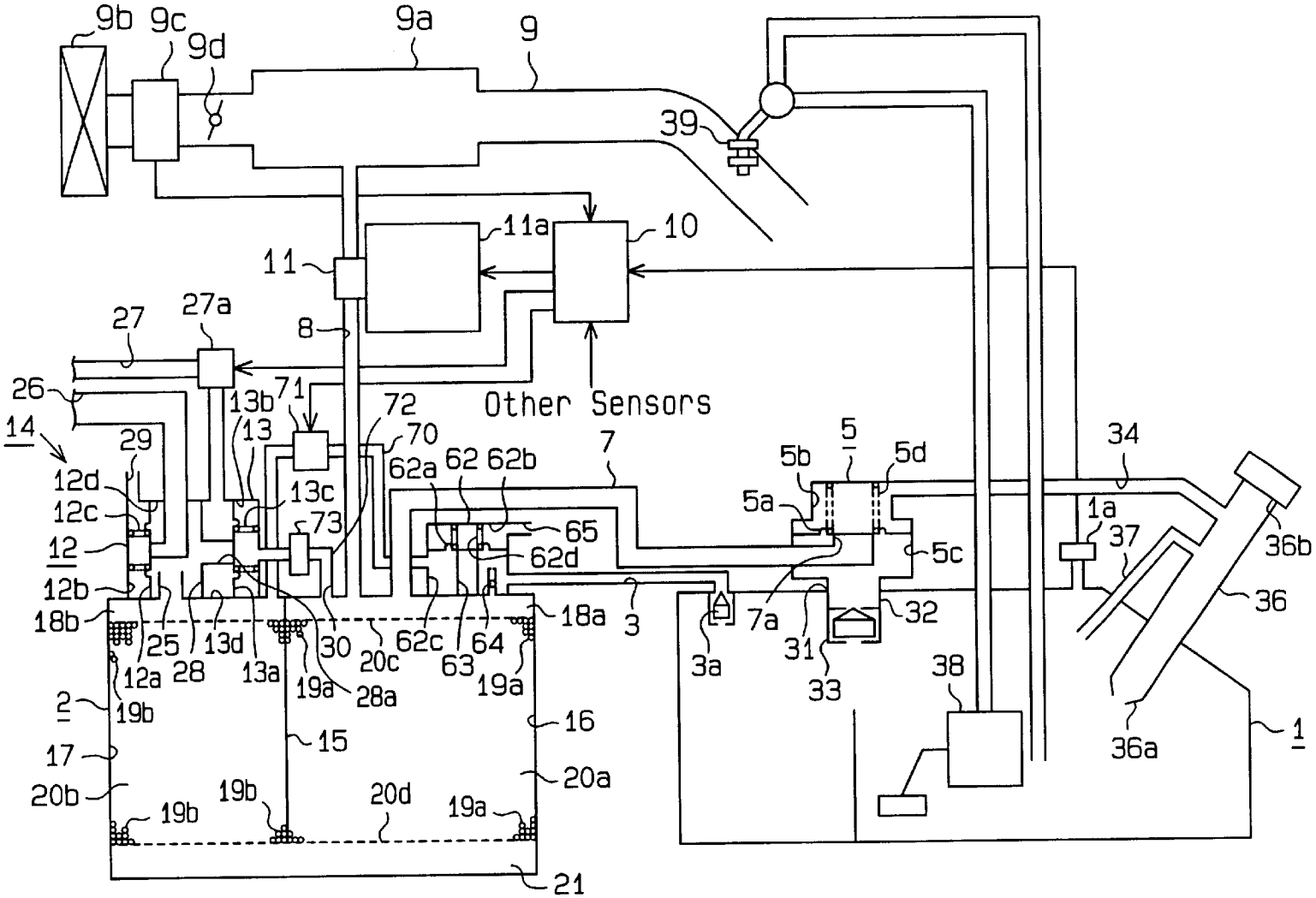
FIG. 21 is diagrammatic view showing a fuel vapor purge system according to a sixth embodiment.

A sixth embodiment of the present invention will now be described with reference to FIG. 21. Like or the same reference numerals are given to those components that are like or the same as the corresponding components of the purge system of FIG. 1. The differences from the first embodiment will mainly be discussed below.

The purge system according to the sixth embodiment has a vapor introducing port 63, which is located above the main chamber 16 of the canister 2. The vapor introducing port 63 draws fuel vapor from the fuel tank 1 to the canister 2. Also, a check ball type vapor relief valve 64 is located to the right of the vapor port 63 as viewed in FIG. 21. When the pressure in the fuel tank 1 is negative, the relief valve 64 opens.

A tank pressure control valve 62 is located on the canister 2 to cover the vapor introducing port 63. The control valve 62 has a diaphragm 62*a* to close the distal opening of the vapor introducing port 63. The diaphragm 62*a* also vertically separates the interior of the valve 62. The upper space of the diaphragm 62*a* is a back pressure chamber 62*b* and the lower space is a positive pressure chamber 62*c*. A port 65 is formed in the sidewall of the back pressure chamber 62*b* to expose the chamber 62*b* to atmospheric pressure. The positive pressure chamber 62*c* is connected to the fuel tank 1 through the fuel vapor passage 3.

A spring 62*d* is located in the back pressure chamber 62*b* to press the diaphragm 62*a* against the opening of the vapor introducing port 63. Therefore, the control valve 62 is closed as long as the pressure in the fuel tank 1 is less than a predetermined level.

A port 25 is formed above the auxiliary chamber 17 in the canister 2. An atmospheric control valve 14 covers the port 25. The negative pressure chamber 13*b* of the control valve 13 is connected to the main chamber 16 of the canister 2 through a pressure passage 72. A buffer valve 73 is located in the pressure passage 72. The buffer valve 73 has the same structure as the buffer valve 40 of the first embodiment.

When the engine is running, negative pressure is generated in the surge tank 9*a*. The negative pressure in the surge tank 9*a* purges adsorbed fuel in the canister 2 to the intake passage 9 of the engine. At this time, the negative pressure chamber 13*b* is exposed to the intake pressure through the pressure passage 72. When the difference between the intake pressure in the chamber 13*b* and the atmospheric pressure in the chamber 13*d* reaches a predetermined level, the control valve 13 is opened. Accordingly, the atmospheric air is drawn into the auxiliary chamber 17 of the canister 2 through the pressure port 28*a* and the port 25. The introduced atmospheric air causes fuel vapor adsorbed in the activated carbon adsorbents 19*a*, 19*b* in the main and auxiliary chambers 16, 17 to flow to the purge line 8. The vapor fuel is therefore purged into intake air in the surge tank 9*a*.

A block valve 27*a* is located in the introducing passage 27. The block valve 27*a* is normally open. During a malfunction test, the ECU 10 actuates the valve 27*a*. The valve 27*a* is, for example, a vacuum switch valve.

When fuel is being supplied to the fuel tank 1, pressure is applied to the canister 2 through the breather passage 7, which increases pressure in the positive pressure chamber 12*d* of the release control valve 12. When the difference between the pressure in the chamber 12*d* and the atmospheric pressure, which is introduced into the chamber 12*b* through the exposure port 29, reaches a predetermined level, the release control valve 12 is opened. Accordingly, air from which fuel vapor is removed in the main and auxiliary chambers 16, 17 is discharged through the port 25 and the discharge port 26.

The positive pressure chamber 62*c* of the control valve 62 is connected to the auxiliary chamber 17 of the canister 2 through a bypass passage 70. The fuel tank 1 is connected to the canister 2 through the bypass passage 70, the positive pressure chamber 62*c* of the control valve 62 and the introducing passage 3. A bypass valve 71 is located in the bypass passage 70. The bypass valve 71 is normally closed. During a malfunction test, the ECU 10 actuates the bypass valve 71 to adjust the opening size of the bypass passage 70. The bypass valve 71 is, for example, a vacuum switch valve.

The other structure of the purge system according to the sixth embodiment is the same as that of the first embodiment.

The purge system according to the sixth embodiment operates in the following manner.

Fuel in the fuel tank 1 evaporates, which increases the pressure in the tank 1. When the pressure in the fuel tank 1 reaches a predetermined level, the tank pressure control valve 62 is opened. Then, vapor fuel flows in the passage 3 from the fuel tank 1 to the canister 2. Therefore, fuel vapor in the fuel tank 1 is drawn into the canister 2 through the control valve 62.

When reaching the canister 2, the vapor fuel is adsorbed by the activated carbon adsorbent 19*a*, 19*b* as in the first embodiment.

Most of fuel in the fuel vapor is removed by the adsorbents 19*a*, 19*b* in the layers 20*a*, 20*b*. The gas then opens the release control valve 12 and is discharged to the outside through the discharge port 26. At this time, the pressure in the negative pressure chamber 13*b* of the atmosphere introduction control valve 13 is positive and is higher than the pressure in the atmospheric pressure chamber 13*d*. Therefore, the control valve 13 is not opened. Thus, fuel vapor does not leak to the outside through the control valve 13 and the introducing passage 27.

When the vehicle is parked at one place for a relatively long period, the tank 1 is cooled and fuel vapor is no longer generated. When the pressure in the tank 1 is lower than the pressure in the canister 2, the pressure in the positive pressure chamber 62*c* of the control valve 62 is negative. Therefore, the check ball of the vapor relief valve 64 is moved upward to open the valve 64, which returns fuel vapor in the canister 2 to the fuel tank 1 through the fuel vapor passage 3.

The malfunction test is performed when the pressure change amount $\Delta P1$ is less than a predetermined value. To measure the pressure change amount in the fuel tank 1, the pressure in the fuel tank 1 is equalized with atmospheric pressure. Then, the pressure at a certain time is subtracted from the pressure at another time to compute the pressure difference, or the pressure change amount. To introduce negative pressure, the block valve 27*a* is closed, and the purge control valve 11 and the bypass valve 71 are opened. The bypass valve 71 is opened such that the fuel tank 1 is connected with the canister 2. The purge control valve 11 is opened to expose the fuel tank 1 and the canister 2 to the negative pressure of the surge tank 9*a*. Accordingly, the pressure in the fuel tank 1 and that of the canister 2 are the same negative pressure. The pressure change rate is measured when the negative pressure in the fuel tank 1 reaches a predetermined level for testing.

If the pressure in the fuel tank 1 fluctuates due to the condition of the road surface after introducing the negative pressure, the malfunction test is stopped. In this case, the pressure change amount $\Delta P1$ is measured again, and the ECU 10 determines whether the measured pressure change amount $\Delta P1$ is less than a predetermined level. At this time, the pressure in the fuel tank 1 must be increased to atmospheric pressure. Therefore, the block valve 27*a* and the bypass valve 71 are opened while the purge control valve 11 is kept closed. Accordingly, atmospheric air is drawn into the canister 2 and the fuel tank 1 through the introducing passage 27.

When the block valve 27*a* is opened, the negative pressure Pn1 in the purge line 8 and the canister 2 is equal to the negative pressure Pn2 in the negative pressure chamber 13*b*. The force based on the negative pressure Pn2 is greater than the force of the spring 13*c*, which greatly displaces the diaphragm 13*a*. In other words, the introducing passage 27 is widely opened. Thus, a great amount of air flows into the passage 27, which rapidly increases the pressure in the purge line 8 toward the atmospheric pressure. However, the buffer valve 73 delays the increase of the pressure in the negative pressure chamber 13*b*. Therefore, the control valve 13 is maintained open for a long period, which reduces the time required for the pressure in the purge line 8 to reach atmospheric pressure. In other words, the purging time is extended.

It should be apparent to those skilled in the art that the present invention may be embodied in many other specific forms without departing from the spirit or scope of the invention. Particularly, it should be understood that the invention may be embodied in the following forms.

In the sixth embodiment, the buffer valve 73 may be replaced by the control valve 48 of the second embodiment. In this case, the same advantages as the sixth embodiment are obtained.

In the illustrated embodiment, the pressure sensor la is located in the fuel tank 1. However, the pressure sensor 1*a* may be located any place as long as the sensor 1*a* detects the pressure in the purge system. For example, the sensor 1*a* may be located in the canister 2.

Therefore, the present examples and embodiments are to be considered as illustrative and not restrictive and the invention is not to be limited to the details given herein, but may be modified within the scope and equivalence of the appended claims.

What is claimed is:

1. A malfunction test apparatus for a fuel vapor purge system, comprising:

a purge system, wherein the purge system connects a fuel tank with a canister and collects fuel vapor generated in the fuel tank in the canister, wherein the purge system purges the collected fuel vapor to an intake passage of an internal combustion engine through a purge passage, the purge passage including the fuel tank; and testing means, wherein the testing means seals the purge passage and measures a change of pressure due to fuel vapor generation in the fuel tank, wherein the testing means measures a rate of change of the pressure in the purge passage after differentiating the pressure in the purge passage from the pressure outside the purge passage and after sealing the purge passage, and wherein the testing means determines whether there is a leak in the purge passage based on the change of pressure due to fuel vapor generation and on the measured rate of change of the pressure in the purge passage, wherein, after measuring the change of pressure due to fuel vapor generation, the testing means determines that there is a leak in the purge passage only if the change of pressure due to fuel vapor generation satisfies a predetermined condition.

2. A malfunction test apparatus for a fuel vapor purge system, comprising:

a purge system, wherein the purge system connects a fuel tank with a canister and collects fuel vapor generated in the fuel tank in the canister, wherein the purge system purges the collected fuel to an intake passage of an internal combustion engine through a purge passage, the purge passage including the fuel tank; and testing means, wherein the testing means seals the purge passage and measures a change of pressure due to fuel vapor generation in the fuel tank, wherein the testing means measures a rate of change of the pressure in the purge passage after differentiating the pressure in the purge passage from the pressure outside the purge passage and after sealing the purge passage, and wherein the testing means determines whether there is a leak in the purge passage based on the change of pressure due to the fuel vapor generation and on the measured rate of change of the pressure in the purge passage, wherein the testing means measures the change of pressure due to the fuel vapor generation after measuring the rate of change of pressure in the purge passage.

3. The malfunction test apparatus according to claim 2, wherein the testing means measures the change of pressure due to the fuel vapor generation only when the testing means indicates that there may be leakage in the purge passage.

4. A malfunction test apparatus for a fuel vapor purge apparatus, comprising:

a purge apparatus, wherein the purge apparatus collects fuel vapor generated in a fuel tank in a canister, wherein the purge apparatus purges the collected fuel to an intake passage of an internal combustion engine through a purge passage, the purge passage including the fuel tank;

testing means, wherein the testing means seals the purge passage and measures a change of pressure due to fuel vapor generation in the fuel tank, wherein the testing means measures a rate of change of the pressure in the purge passage after differentiating the pressure in the purge passage from the pressure outside the purge passage and after sealing the purge passage, and wherein the testing means determines whether there is a leak in the purge passage based on the change of pressure due to the fuel vapor generation and on the measured rate of change of the pressure in the purge passage, wherein the testing means determines whether there is a leak in the purge system based on a change of the pressure in the purge passage while maintaining negative pressure in the purge passage, and wherein the testing means measures the change of pressure due to the fuel vapor generation based on the rate of change of the pressure in the purge passage after the pressure in the purge passage is equalized with the atmospheric pressure; and pressure returning means for accelerating an increase of the pressure in the purge passage to the atmospheric pressure after the leakage test is completed or after the leakage test is discontinued.

5. The malfunction test apparatus according to claim 4, wherein the pressure returning means includes an atmosphere introducing control valve located in a passage that introduces atmospheric air into the purge passage, and wherein the pressure returning means delays movement of the atmosphere introducing control valve from an opened state to a closed state.

6. The malfunction test apparatus according to claim 5, further including bypass means, which bypasses the atmosphere introducing control valve, wherein the bypass means introduces the atmospheric air into the purge passage when the pressure in the purge passage is lowered by an amount that is more than a predetermined value.

7. A method for determining whether a malfunction has occurred in a fuel vapor purge system, wherein the purge system connects a fuel tank with a canister and collects fuel vapor generated in the fuel tank by the canister, wherein the purge system purges the collected fuel vapor to an intake passage of an internal combustion engine through a purge passage, wherein the purge passage includes the fuel tank, the method comprising:

measuring a change of pressure due to fuel vapor generation in the fuel tank while sealing the purge passage;

measuring a rate of change of the pressure in the purge passage after differentiating the pressure in the purge passage from the pressure outside the purge passage and after sealing the purge passage;

determining whether there is a leak in the purge passage based on the change of pressure due to fuel vapor generation and on the measured rate of change of the pressure in the purge passage; and determining that there is a leak in the purge passage only if the change of pressure due to fuel vapor generation satisfies a predetermined condition.

8. A method for testing whether a malfunction has occurred in a fuel vapor purge system, wherein the purge system connects a fuel tank with a canister and collects fuel vapor generated in the fuel tank by the canister, wherein the purge system purges the collected fuel vapor to an intake passage of an internal combustion engine through a purge passage, the purge passage including the fuel tank, the method comprising:

measuring a rate of pressure change in the purge passage after differentiating the pressure in the purge passage from the pressure outside the purge passage and after sealing the purge passage;

measuring a change of pressure due to fuel vapor generation in the fuel tank while sealing the purge passage; and determining whether there is a leak in the purge passage based on the measured change of pressure due to fuel vapor generation and the rate of pressure change in the purge passage.

9. The method according to claim 8, wherein the amount of generated fuel vapor is measured only when there is an indication that the purge passage may have a leak.

10. A method for determining whether a malfunction has occurred in a fuel vapor purge system, wherein the purge system collects fuel vapor generated in a fuel tank by a canister, wherein the purge system purges the collected fuel vapor to an intake passage of an internal combustion engine through a purge passage, the purge passage including the fuel tank, the method comprising:

measuring a change of pressure due to fuel vapor generation in the fuel tank while sealing the purge passage;

measuring a rate of the pressure in the purge passage after differentiating the pressure in the purge passage from the pressure outside the purge passage and after sealing the purge passage;

testing for a leak in the purge passage based on the measured pressure change due to fuel vapor generation and the rate of change of the pressure in the purge passage, wherein leakage is detected based on the rate of change of the pressure in the purge passage while maintaining negative pressure in the purge passage, and wherein the pressure change due to the fuel vapor generation is measured based on the rate of change of the pressure in the purge passage after the pressure in the purge passage is equalized with the atmospheric pressure; and accelerating an increase of the pressure in the purge passage to atmospheric pressure after the leakage test.

11. The method according to claim 10, wherein the increase of the pressure in the purge passage is accelerated by delaying movement of an atmosphere introducing control valve located in a passage that exposes the purge passage to atmospheric pressure from an opened state to a closed state.

12. The method according to claim 11 further including introducing atmospheric air into the purge passage when the pressure in the purge passage is lowered by an amount that is more than a predetermined value.

* * * * *